US009117428B2

(12) United States Patent
Ierymenko

(10) Patent No.: US 9,117,428 B2
(45) Date of Patent: Aug. 25, 2015

(54) STRINGED INSTRUMENT WITH ACTIVE STRING TERMINATION MOTION CONTROL

(71) Applicant: Paul F. Ierymenko, Raleigh, NC (US)

(72) Inventor: Paul F. Ierymenko, Raleigh, NC (US)

( * ) Notice: Subject to any disclaimer, the term of this patent is extended or adjusted under 35 U.S.C. 154(b) by 0 days.

(21) Appl. No.: 13/901,865

(22) Filed: May 24, 2013

(65) Prior Publication Data

US 2013/0255477 A1 Oct. 3, 2013

Related U.S. Application Data

(63) Continuation of application No. 12/772,440, filed on May 3, 2010, now Pat. No. 8,450,593, and a continuation-in-part of application No. 12/708,234, filed on Feb. 18, 2010, now abandoned, which is a continuation-in-part of application No. 10/554,480, filed as application No. PCT/US2004/018072 on Jun. 8, 2004, now Pat. No. 7,667,131.

(60) Provisional application No. 61/174,728, filed on May 1, 2009, provisional application No. 60/476,943, filed on Jun. 9, 2003.

(51) Int. Cl.

| | |
|---|---|
| ***G10H 3/18*** | (2006.01) |
| ***G10D 3/04*** | (2006.01) |
| ***G10D 3/14*** | (2006.01) |
| ***G10H 3/22*** | (2006.01) |
| ***G10H 3/26*** | (2006.01) |

(52) U.S. Cl.

CPC .. *G10H 3/18* (2013.01); *G10D 3/04* (2013.01); *G10D 3/143* (2013.01); *G10H 3/182* (2013.01); *G10H 3/22* (2013.01); *G10H 3/26* (2013.01); *G10H 2210/086* (2013.01); *G10H 2210/201* (2013.01); *G10H 2210/221* (2013.01); *G10H 2220/181* (2013.01); *G10H 2220/411* (2013.01); *G10H 2220/435* (2013.01); *G10H 2240/311* (2013.01)

(58) Field of Classification Search

USPC ..... 84/723
IPC ..... G10H 3/18,3/182
See application file for complete search history.

(56) References Cited

U.S. PATENT DOCUMENTS

| | | | | | |
|---|---|---|---|---|---|
| 3,446,905 | A | * | 5/1969 | Roberts | 84/676 |
| 3,813,473 | A | | 5/1974 | Terymenko | |
| 4,236,433 | A | | 12/1980 | Holland | |
| 4,674,069 | A | * | 6/1987 | Mizuno | 367/90 |
| 4,723,468 | A | * | 2/1988 | Takabayashi et al. | 84/722 |
| 4,817,484 | A | * | 4/1989 | Iba et al. | 84/735 |
| 4,951,545 | A | * | 8/1990 | Yoshida | 84/646 |
| 4,966,052 | A | * | 10/1990 | Shiraki et al. | 84/715 |
| 4,995,292 | A | * | 2/1991 | Nomura | 84/726 |
| 5,005,461 | A | * | 4/1991 | Murata | 84/646 |
| 5,009,142 | A | | 4/1991 | Kurtz | |

(Continued)

*Primary Examiner* — David Warren
(74) *Attorney, Agent, or Firm* — Myers Bigel Sibley & Sajovec, PA

(57) ABSTRACT

A system for controlling for at least one string of a musical instrument by selectively exciting or damping vibration of the string is provided. The system includes at least one transducer configured to sense a lateral vibration of the string and/or to apply an actuating force to the string. A controller is configured to determine an actuating signal for driving the actuator to apply a longitudinal actuating force to the string at a termination point of the string. The longitudinal actuating force are operable to modulate a tension of the string that increases and/or damps the lateral vibration and/or selected harmonics thereof.

11 Claims, 14 Drawing Sheets

(56) References Cited

U.S. PATENT DOCUMENTS

| | | | | |
|---|---|---|---|---|
| 5,010,800 | A * | 4/1991 | Yoshida | 84/646 |
| 5,014,588 | A * | 5/1991 | Omata et al. | 84/726 |
| 5,024,134 | A * | 6/1991 | Uchiyama | 84/654 |
| 5,033,353 | A * | 7/1991 | Fala et al. | 84/72 |
| 5,113,742 | A * | 5/1992 | Matsumoto | 84/615 |
| 5,121,669 | A * | 6/1992 | Iba et al. | 84/735 |
| 5,524,521 | A * | 6/1996 | Clift et al. | 84/462 |
| 5,585,588 | A | 12/1996 | Tumura | |
| 5,760,321 | A | 6/1998 | Seabert | |
| 5,767,429 | A | 6/1998 | Milano et al. | |
| 5,886,270 | A | 3/1999 | Wynn | |
| 5,932,827 | A | 8/1999 | Osborne et al. | |
| 6,034,316 | A | 3/2000 | Hoover | |
| 6,577,738 | B2 * | 6/2003 | Norris et al. | 381/77 |
| 7,223,913 | B2 * | 5/2007 | Knapp et al. | 84/722 |
| 7,385,125 | B2 | 6/2008 | Motsenbocker | |
| 7,446,248 | B2 | 11/2008 | Skinn et al. | |
| 7,453,040 | B2 | 11/2008 | Gillette | |
| 7,534,950 | B2 | 5/2009 | Lyles | |
| 7,538,268 | B2 * | 5/2009 | Marcus | 84/723 |
| 7,667,131 | B2 * | 2/2010 | Ierymenko | 84/735 |
| 7,777,115 | B2 | 8/2010 | Komatsu et al. | |
| 7,935,876 | B1 | 5/2011 | West | |
| 8,129,607 | B2 | 3/2012 | Loftus | |
| 8,450,593 | B2 * | 5/2013 | Ierymenko et al. | 84/723 |
| 8,686,274 | B2 * | 4/2014 | Fukuda et al. | 84/616 |
| 8,735,710 | B2 * | 5/2014 | Yamabata | 84/627 |
| 2002/0069749 | A1 | 6/2002 | Hoover et al. | |
| 2003/0226441 | A1 | 12/2003 | Barney | |
| 2004/0007116 | A1 * | 1/2004 | Marcus | 84/10 |
| 2004/0065188 | A1 * | 4/2004 | Stuebner et al. | 84/723 |
| 2005/0081703 | A1 | 4/2005 | Hoover | |
| 2006/0090632 | A1 | 5/2006 | Ludwig | |
| 2006/0107826 | A1 * | 5/2006 | Knapp et al. | 84/724 |
| 2006/0213358 | A1 | 9/2006 | Motsenbocker | |
| 2006/0243123 | A1 * | 11/2006 | Ierymenko | 84/742 |
| 2007/0256551 | A1 * | 11/2007 | Knapp et al. | 84/722 |
| 2008/0105108 | A1 | 5/2008 | Saenz | |
| 2009/0199699 | A1 * | 8/2009 | Marcus | 84/723 |
| 2009/0223353 | A1 * | 9/2009 | Loftus | 84/726 |
| 2009/0320671 | A1 | 12/2009 | Meeks et al. | |
| 2010/0064877 | A1 | 3/2010 | Deck | |
| 2010/0089219 | A1 | 4/2010 | D'Arco | |
| 2010/0263521 | A1 * | 10/2010 | Ierymenko et al. | 84/726 |
| 2010/0275761 | A1 * | 11/2010 | Ierymenko | 84/731 |
| 2011/0132180 | A1 * | 6/2011 | Gobbers | 84/622 |
| 2012/0137856 | A1 * | 6/2012 | Fukuda et al. | 84/616 |
| 2013/0205978 | A1 * | 8/2013 | Yamabata | 84/616 |
| 2013/0255477 | A1 * | 10/2013 | Ierymenko et al. | 84/723 |

* cited by examiner

Inside Block 704:

Pitch Estimation, Spectral Analysis
200
1.5
input_k
-1.5
0
k
512
String Vibration Motional History From Memory 250
202
(n = 512)
Autocorrelation
204
206
.4
P
auto_kb
- .4
0
kb
255
Find Frequency
208
Pitch
Resample
210
1.5
Resamp_index
-1.5
0
index
127
Amplitude Feature Extractor
Cycle RMS
Cycle Crest Factor
Cycle Peak
212
214
Fast Fourier Transform
Spectrum
IFFT Harmonics
5
2.5
0
0
2
4
6
8
10
12
14
16
Harmonics
0
15
88

Motion Controller 20 Interface
Input Ref Spectra Audio
76
78
48
26
22
Mixer
Audio Output
50
External Audio Input
40
34
84
88
Waveform Server
36
32
28
30
Supervisor
250
Memory
254
Spectra Server
256
Spectral Balance
258
252
Vibrato
260
262
Glissando
264
266
Note Onset
268
272
Muting
270
Last String
274
Phrases
276
286
278
Instrument Definitions
280
Command Executive
282
Master Program
284
Communication Interface
38
Physical User Controls
82
Digital Interface
Aux UI
80

STRINGED INSTRUMENT WITH ACTIVE STRING TERMINATION MOTION CONTROL

RELATED APPLICATIONS

This application is a divisional of U.S. application Ser. No. 12/772,440 filed May 3, 2010 which claims priority to U.S. Provisional Application No. 61/174,782, filed May 1, 2009, and which is a continuation-in-part of U.S. application Ser. No. 12/708,234, filed Feb. 18, 2010, which is a continuation of and claims priority to application Ser. No. 10/554,480, filed Oct. 24, 2005 (now issued U.S. Pat. No. 7,667,131), and which is a national phase application claiming priority to of PCT International Application No. PCT/US2004/018072 having an international filing date of Jun. 8, 2004, which in turn claims priority to U.S. Provisional Patent Application No. 60/476,943 filed Jun. 9, 2003, the disclosures of each of which are hereby incorporated by reference in their entireties.

FIELD OF THE INVENTION

The present invention relates to the field of stringed musical instruments, and in particular to interfaces between players and instruments.

BACKGROUND

Stringed instruments have included simple electromagnetic or piezoelectric pickups for sound enhancements. Signal processing effects and guitar "sustainers" that employ a feedback loop around the string to produce prolonged notes are also known.

SUMMARY OF EMBODIMENTS OF THE INVENTION

In some embodiments according to the present invention, a system for controlling for at least one string of a musical instrument by selectively exciting or damping vibration of the string is provided. The system includes at least one transducer configured to sense a lateral vibration of the string and/or to apply an actuating force to the string. A controller is configured to determine an actuating signal for driving the actuator to apply a longitudinal actuating force to the string at a termination point of the string. The longitudinal actuating force is operable to modulate a tension of the string that increases (excites) and/or damps the lateral vibration and/or selected harmonics thereof.

In some embodiments, a system for controlling for at least one string of a musical instrument by selectively exciting or damping vibration of the string includes at least one transducer configured to sense a lateral vibration of the string and/or to apply an actuating force to the string. A controller is configured to generate an actuating signal for driving the at least one transducer to apply an actuating force transversely to the string at one termination point of the string to move or vibrate the termination point. The actuating force is operable to excite or/or damp a lateral string vibration and/or selected harmonics thereof, and the controller is configured to generate the actuating signal by separating selected harmonics of the string into individual signals, modifying an amplitude and/or polarity of the selected harmonics, and summing the modified amplitude and/or polarity of the selected harmonics to provide the actuation signal.

In some embodiments, a circuit for sensing motion of a musical instrument string includes an ultrasonic emitter configured to emit ultrasonic vibrations of a wavelength smaller than a diameter of the string so that ultrasonic vibrations from the ultrasonic emitter impinge upon and are reflected by the string. At least one ultrasonic sensor is configured to receive the ultrasonic vibrations reflected by the string.

In some embodiments, a saddle apparatus for terminating a vibrating portion of a musical instrument string and for anchoring the string to support a tension of the string such that a point of string termination may be driven to move or vibrate longitudinally along the string axis to modulate the tension of the string is provided. The saddle apparatus includes a lever having at least a first and second free end and configured to pivot at a pivot. The lever depends substantially at its center from the pivot, and the first free end of the lever is configure to prove a musical string saddle termination for anchoring and terminating one end of a vibrating portion of the string, and the second free end of the lever is attached to a spring. The pivot and the spring are connected to an instrument bridge assembly such that a tension of the string is balanced across the lever and against the pivot by the tension of the spring such that the lever is at an equilibrium position. At least one transducer includes an actuator configured to drive the lever to upset the equilibrium of the spring and the string in accordance with an actuation signal to thereby move and/or vibrate a point of termination of string motion.

In some embodiments, methods of controlling the vibration of a musical instrument string include integrating a sensed signal representing a velocity of lateral string vibration to produce a displacement signal. A product of a velocity signal and a displacement signal is calculated. The product of the velocity signal and the displacement signal is scaled to fit within a range of available actuation. An actuating pulse of selected polarity having energy proportional to a product of an instantaneous velocity and displacement is generated, and the pulse is applied to at least one transducer to cause a change in a tension of the string.

In some embodiments, methods of controlling the vibration of a musical instrument string and/or selected harmonics thereof by moving and/or vibrating a termination point of the string include separating a sensed signal representing a velocity of lateral string vibration into constituent harmonics thereof. An integral of individual harmonic constituents is calculated to provide a corresponding set of displacement constituents. A product of each pair of constituents is calculated such that a first constituent of the pair of constituents represents an instantaneous velocity of a harmonic determined by the separating step and the second constituent of the pair of constituents represents a corresponding displacement from the calculating step. Actuating signal harmonic components are scaled and polarized for controlling the vibration of the string.

According to some embodiments, methods of controlling a vibration of a musical instrument string and/or individual harmonics include sensing string motion using a sensor to determine an actual vibration of the string. An actuator is driven and is coupled to the string by a time domain signal having a specified spectral characteristic that is held in a specified synchronized relationship in frequency and phase to the actual vibration of the string as measured by the sensor such that the spectral characteristic is not directly and instantaneously derived from the sensed string motion. The specified synchronized relationship is in frequency and phase and the specified spectral characteristic being determined by user control.

BRIEF DESCRIPTION OF THE DRAWINGS

The accompanying drawings, which are incorporated in and constitute a part of the specification, illustrate embodiments of the invention and, together with the description, serve to explain principles of embodiments of the invention.

Figure 9:
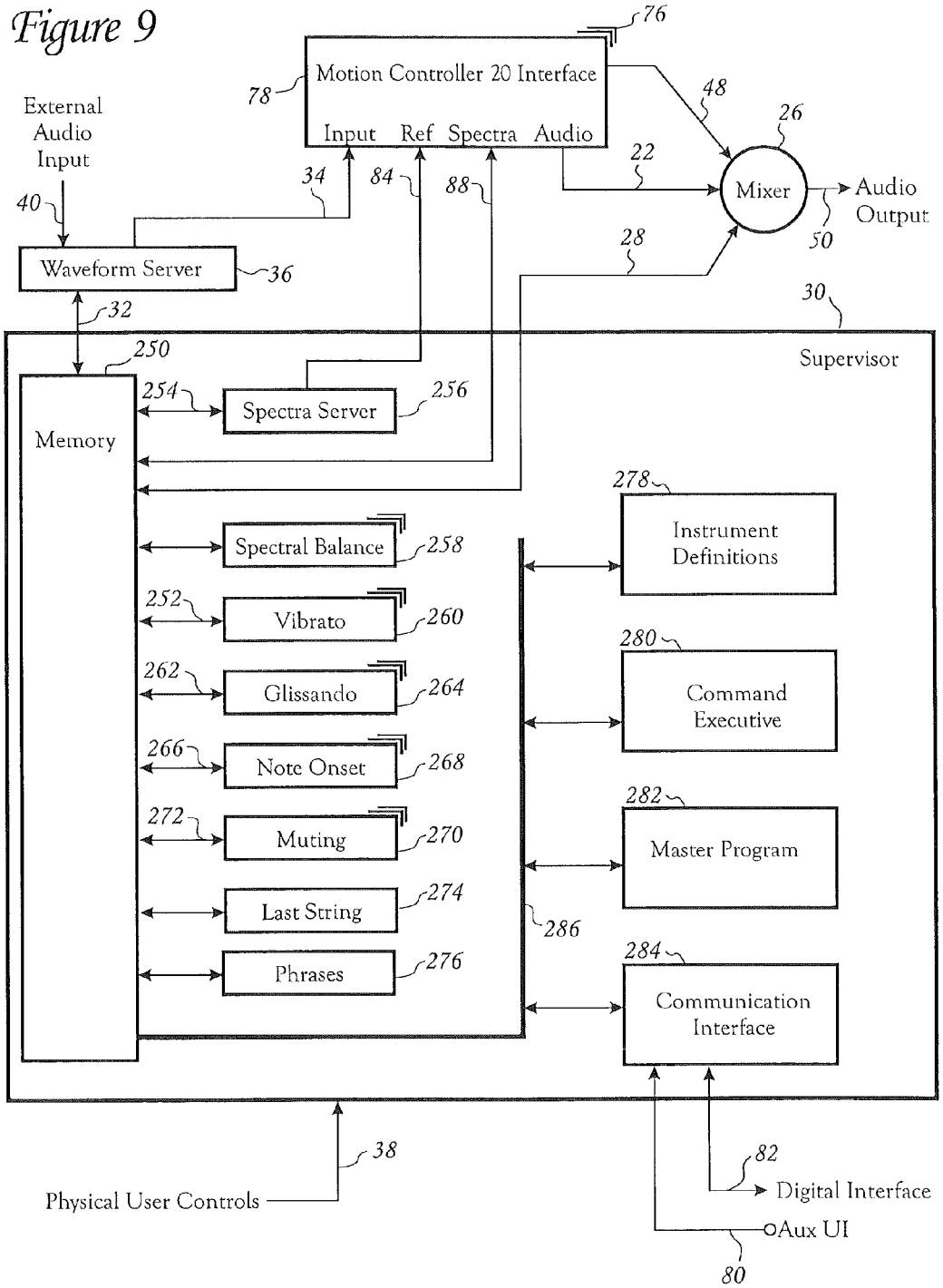
FIG. 9 is a schematic diagram of a supervisor unit according to some embodiments of the invention.

In all figures, except FIG. 9, elements that are replicated for each string but are otherwise identical are subscripted. In the text these subscripts are referenced only when it is necessary to differentiate between instances of an element. If no subscripts appear, then the material is intended to apply equally to all instances of the element.

DETAILED DESCRIPTION OF EMBODIMENTS OF THE INVENTION

The present invention now will be described hereinafter with reference to the accompanying drawings and examples, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under." The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present invention. The sequence of operations (or steps) is not limited to the order presented in the claims or figures unless specifically indicated otherwise.

The present invention is described below with reference to block diagrams and/or flowchart illustrations of methods, apparatus (systems) and/or computer program products according to embodiments of the invention. It is understood that each block of the block diagrams and/or flowchart illustrations, and combinations of blocks in the block diagrams and/or flowchart illustrations, can be implemented by computer program instructions. These computer program instructions may be provided to a processor of a general purpose computer, special purpose computer, and/or other programmable data processing apparatus to produce a machine, such that the instructions, which execute via the processor of the computer and/or other programmable data processing apparatus, create means for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

Accordingly, the present invention may be embodied in hardware and/or in software (including firmware, resident software, micro-code, etc.). Furthermore, embodiments of the present invention may take the form of a computer program product on a computer-usable or computer-readable storage medium having computer-usable or computer-readable program code embodied in the medium for use by or in connection with an instruction execution system.

According to some embodiments of the invention, a control system is employed that interacts with a string of a musical instrument at one of the two points of termination of the string vibration by moving and/or vibrating the point of termination.

In some embodiments, both longitudinal and transverse motion of the string termination point is employed in a dual control system to achieve robust control of virtually all of the dynamic behavior of a musical instrument string.

U.S. Pat. No. 6,216,059, which is incorporated herein by reference in its entirety, describes a collocated control system interacting magnetically with a string to control string motion with velocity feedback to the string at a point along its length. The velocity control method described in U.S. Pat. No. 6,216,059 may used in place of either tension control or transverse control to form a dual control system. Moreover, it should be understood that conventional velocity driving "sustainer," as described in U.S. Pat. No. 5,233,123, may be used. U.S. Pat. No. 5,233,123 is hereby incorporated by reference in its entirety. In some embodiments, tension control is a used to control string vibration.

On a stringed musical instrument, the physical device that terminates the string vibration is known as a "saddle." The physical end of the string extends beyond the point of termination at the saddle and is secured against the tension of the string to keep the string taut. The saddle of the instant invention is driven longitudinally to vary the tension of the string and transversely to directly affect lateral string vibration.

In some embodiments, the tension of the string is modulated by moving the saddle longitudinally according to a control function computed by either an analog or a digital signal processing circuit that receives an input signal from a sensor responsive to lateral vibration of the string. Herein this aspect is termed "tension control."

In some embodiments, the saddle is moved transversely according to a control function computed by either an analog or digital signal processing circuit that receives an input signal from a sensor responsive to lateral vibration of the string. Herein this aspect is termed "transverse control."

In some embodiments, the string is driven by a control system operating according to the invention of U.S. Pat. No. 6,216,059. Herein this aspect is termed "velocity control."

A "dual control system" utilizes methods of controlling the vibrations of a musical instrument string that combines any two of three different controllers having different and complementary control characteristics. The possible combinations include tension control and transverse control, or tension control and velocity control, or transverse control and velocity control.

A piezoelectric bending actuator is a commercially available actuator developed to increase the range of motion afforded by a piezoelectric actuator and includes a sandwich of piezoelectric material bonded to a substrate. When the piezoelectric material is elongated by the application of a drive voltage, the sandwich is forced to bend in a direction normal to its plane and the travel at the end of the sandwich can be many times the distance of the actual piezoelectric elongation.

The term "controller" refers to a system which receives signals from a sensing transducer and applies actuating signals to the actuating transducer to modify the motion of the string.

The term "supervisor" refers to a supervisory system or module that may include signal storage facilities and data processing capabilities capable of interpreting certain input from the user referred to as preselected player techniques in the form of selected characteristic features of the string's motion via the sensed output signals and provides control signals to the controller to govern the behavior of the controller accordingly. The controller and/or supervisor and their associated functions may be provided by the same or by different components.

The term "timbre" refers to the harmonic spectrum of a note.

The term "pitch" refers to the frequency of the fundamental mode of lateral string vibration.

The terms "lateral" and "transverse" identify a direction of motion at an angle generally normal to the string axis; the usual musical vibration of a string is a transverse standing wave vibration where the string moves side to side, i.e., laterally. In contrast, the term "longitudinal motion" is a motion generally along the length of the string coincident with or parallel to the axis of the string.

The term "playing techniques" includes actions a guitarist learns to achieve a certain nuance or effect in playing his instrument. Playing techniques include but are not limited to vibrato and glissando or bending of the string, muting the strings, and various styles and methods of plucking and muting the strings such as the deliberate touching of harmonic nodes of strings. Playing techniques may be detected by detecting various physical characteristics of string vibration.

The term "transducer" refers to a sensor, an actuator, or a sensor/actuator.

The term "control signal" refers to any signal used to control something.

The term "technique command" refers to a control signal that represents the deliberate will of the instrumentalist, much as if he had turned a dial or closed a switch. Technique commands are also referred to herein according to the type of technique used to issue them, i.e., a "vibrato command" or a "glissando command." Note that most such commands are continuous in both magnitude and time. For example, when an instrumentalist uses vibrato to control the invention it is akin to riding a joystick as against flipping a switch.

The term "recognition" is used herein to convey the idea of a system mimicking a human cognitive process, in that the system recognizes a human player's intent encoded in the characteristics of the musical signal created by the player.

The terms "path" or "data path" or "line" refer to a virtual or physical digital communication connection that may be capable of carrying mixed data including a plurality of signals in both directions.

The term "time frame" refers to the time taken to iterate the control loop once, i.e., the time between one sensing event to the next, i.e., the reciprocal of the control system sample rate with respect to the use of a unitary transducer as descried in U.S. Pat. No. 6,216,059.

The term "muting" refers to an action performed by the instrumentalist and can be a technique command.

The term "damping" is performed by a motion control system. Damping may be the response to a muting command of technique.

The terms "musician," "player," "guitarist," and "instrumentalist" are used interchangeably and should herein be taken to mean, "the player of any stringed instrument."

Embodiments according to the invention combine techniques for sensing and/or influencing the vibration of guitar strings together with methods of user control, that of extracting and interpreting the guitarist's playing techniques as purposeful user commands.

The techniques for sensing and influencing the vibration of strings comprise at least one sensing transducer coupled to each string for sensing the string motion and at least one actuating transducer for effecting a change in the motion of the string under the direction of a supervisor/control system responsive to recognized player techniques.

The skilled guitarist already uses techniques as commands upon his conventional instrument. For example, when he desires vibrato, he "commands" it, usually by slightly modulating the tension of the string with his fretting hand. According to some embodiments of the invention, such playing techniques are recognized by a supervisor unit and interpreted as user commands to the electronics of the invention. According to some embodiments of the invention, by using such playing techniques, the instrumentalist controls electronic parameters that are otherwise often controlled through cumbersome ancillary interfaces such as switches, dials, foot pedals and the like.

Embodiments according to the invention employ the concept of feature extraction such that features of vibrations including but not limited to amplitude, pitch, spectra, note onset and mute are continuously recorded and analyzed to identify musical playing techniques as commands. For example, pitch is analyzed over time to recognize and quantify vibrato and a corresponding vibrato command signal is issued. Such command signals either serve directly as inputs for influencing vibration or the commands alter the selection of inputs for influencing vibration.

These combined elements may empower the guitarist or other stringed instrument player to use playing technique to affect the vibration of the strings of his instrument to a greater and more varied extent than was available to him in a conventional instrument. In some embodiments, notes or chords may be sustained, notes may be muted more easily, and a variety of timbres and harmonic effects may be produced. The user may hear the sounds produced both acoustically and with amplification, and may control the sounds as he plays, without necessarily resorting to a multitude of switches, dials and foot pedals.

Some embodiments according to the present invention will now be described.

Recognition of Technique Commands.

The general concept of controlling digital audio processing effects using control signals derived from features of the sound itself or from other sounds is known and has been applied to music synthesizers and effects devices that process audio signals. See P476 of the book entitled DAFX-Digital Audio Effects published by John Wiley & Sons Ltd.© 2002 ("DAFX"). Embodiments according to the invention include extracting intentional commands from an instrumentalist's purposeful technique and combining the extracted commands with techniques to influence string vibration in accordance with the commands.

Motion Control System with Full Harmonic Control

Some embodiments of the invention act to sustain independently upon each taut string of an instrument the vibration of some selection of harmonics while simultaneously damping some other selection of harmonics, the selections being governed by a reference spectrum.

U.S. Pat. No. 6,216,059 teaches a method of simultaneously exciting and damping selected harmonics on a taut musical instrument string using an array of band pass filters, each filter being individually tuned to a selected harmonic of string vibration and the outputs of the array being individually weighted, polarized and summed to form the actuation signal. Though successful for lower order harmonics, this method may become less practical as the order of the harmonic increases. Consider this sequence of harmonics beginning at 100 Hz: 100, 200, 300, 400, 500, 600 . . . etc. In terms of bandwidth there is an octave between the first and second harmonic but only about half an octave between the second and third. Higher harmonics become increasingly crowded in terms of bandwidth and the band pass filters used to separate them must correspondingly be increasingly narrow. The pitch of a guitar string always wavers slightly making the use of narrow high Q band pass filters less practical and thus limiting the range of harmonics that can be easily addressed. High Q filters have poor transient response and high phase sensitivity; this also limits their practicality.

In some embodiments of the invention, the difficulty of separating higher harmonics is addressed by assigning every other harmonic to a different controller, for example having even order harmonics controlled by tension modulation and odd order harmonics by transverse modulation. Improvement may also be obtained by using transverse modulation to excite new harmonics and damp existing harmonics while using tension modulation to sustain existing harmonics and to correct the pitch error due to transverse modulation. In some embodiments, the harmonics of interest are controlled by controlling each harmonic individually for a period of time and then controlling another harmonic in succession, which may be performed repeatedly.

Embodiments according to the invention make it possible to control strings made of any suitable material including nylon. Both tension control and transverse control work with any type of string because force is coupled to the string mechanically rather than electromagnetically.

In some embodiments, tension control is utilized to correct the undesirable pitch error that accompanies the transverse control method.

According to some embodiments, the lateral vibration of the string may be sensed and applied as an input signal to the control function governing the control system. In some embodiments of the invention, any of several different methods of sensing lateral string vibration may be used to provide the input signal. These include piezoelectric sensing, electromagnetic sensing, optical sensing, and ultrasonic sensing. It is possible to sense lateral vibration by monitoring the string tension.

An actuator may be used to modulate the position of termination of the string, i.e. to move or vibrate the saddle. Any of suitable actuators may be used including but not limited to electromagnetic, piezoelectric and magnetostrictive actuators as would be understood by one of skill in the art.

It should be understood that all of the actuator and sensor techniques and devices identified herein may be variously combined within the scope of the invention. Any substitution of one type of sensor for another or one type of actuator for another is within the scope of the invention and would be understood by one of skill in the art based on the descriptions of particular embodiments herein provided as general examples of all such combinations and embodiments.

Waveform Reference Signal

In some embodiments of the invention, generated or stored time domain waveform signals are applied as reference actuating signals to excite vibrations upon the associated string or strings.

Time and Frequency Domain Reference Signals

Some embodiments of the invention use both time-domain and frequency domain reference inputs. The motion control system of the U.S. Pat. No. 6,216,059 provides for both time-domain and frequency domain reference inputs.

Damping Open Strings

Some embodiments of the invention interpret and extend a guitarist's muting technique to actively damp sympathetic vibrations occurring on unplayed "open" strings to silence unwanted sounds.

Electronic String Excitation

Some embodiments of the invention provide an actuator to "pluck" or otherwise excite string vibration, for example, where none exists.

Mute Technique as a Command Signal

Some embodiments of the invention recognize the instrumentalist's intentional acts of muting the strings and determine a technique command signal therefrom.

Vibrato Technique as a Command Signal

Some embodiments of the invention derive a technique command signal from vibrato technique. The guitarist applies vibrato technique when he "shakes" or bends a string back and forth with his fretting hand to make the pitch waver or uses a vibrato arm.

Vibrato Rate Technique as a Command Signal

In some embodiments according to the invention, the rate of vibrato is measured and extracted as a command signal.

Glissando Technique as a Command Signal

Some embodiments of the invention derive command signals from upward and downward glissando.

Vibrato and Glissando Control Sustain and Timbre

In some embodiments of the invention, the magnitude of the Vibrato command signal governs the intensity of the sustain effect while the Glissando command signal governs timbre, or the reverse, or one and not the other.

Note Onset Amplitude Technique as a Command Signal

Some embodiments of the invention derive a command signal from the greatest amplitude detected when a new note is struck.

Note Onset Spectrum as a Reference Spectrum

Some embodiments of the invention derive a reference spectrum from the spectrum of the note as measured at the instant the string is struck by the guitarist.

Spectral Balance Command Signal

Some embodiments of the invention derive a command signal from the normalized spectral centroid of the string vibration. See page 362 of DAFX. This signal measures how the spectral energy of string vibration is distributed between high and low harmonics. Such a control signal approximately indicates where in relation to the bridge the string was struck.

Some embodiments of the invention use the harmonic balance command signal as a key that selects a particular reference spectrum from a stored palette of spectra. Thus, by striking a note a certain way or at a certain point on the string, the player can invoke a certain selected timbre.

Last String Played Command Signal

Some embodiments of the invention include a mode where only the last string played is permitted to vibrate while the rest of the strings are actively damped. In this mode, it is possible to play arpeggios by holding and strumming chords, even on an acoustic instrument.

Pitch Correction

In some embodiments, there is a user-selectable aspect that acts to pull the pitch of each note towards a stored pitch standard such as an equal tempered scale. As the taut string is part of a harmonic oscillator, by the action of the motion control loop, the pitch of the string can be pulled slightly in either direction from its natural pitch by the control system, permitting minor tuning errors and errors of glissando to be corrected.

Recording of String Attributes and MIDI Output

In some embodiments, vibration feature history in memory is analyzed and expressed as a MIDI or other suitable protocol for controlling and communicating with audio equipment such as synthesizers and other sound sources for the purpose of controlling the equipment or of turning a performance into a musical score, i.e., automatic transcription.

Phrase Recognition Command Signal

In some embodiments, phrase recognition is used in conjunction with a simple switch to invoke modes of the invention. Recently recorded pitch history of the strings is reviewed and compared against deliberately recorded sequences of pitch herein called a "command phrase." The guitarist uses the switch to invoke a temporary phrase-recognition mode when he desires to enter a musical command phrase. He then enters one or a series of notes. The entered phrase is compared against stored command phrases. When a matching sequence is found, the system responds by entering the mode of operation associated with the sequence, thereby executing a phrase command.

Techniques Used in Combination

In some embodiments of the invention, the various playing techniques and the command control signals they generate can be used in any useful combination to control various aspects of the instrument's behavior at once.

In embodiments of the invention the value of one control signal can optionally change the value, polarity or curvature of a second control signal.

Basic Physical Controls

In some embodiments, the guitarist interacts with a minimum number of easily accessible manually operable physical controls. The controls may be of any suitable kind such as a touch-sensitive area, capacitive, mechanical, etc.

In some embodiments of the invention there is a physical control for switching from one mode to another mode of the invention, a physical level control to set the level of the electrical audio signal output from the invention, and a physical control to turn off and on the invention's electronics. There is also an optional touch-sensitive area for selecting along an x-axis the harmonics to be influenced or optionally the strings to be influenced and for controlling along a y-axis the degree of sustain and muting. However, additional physical user controls may be used.

In some embodiments according to the invention, user control signals are generated by detecting the position of the player's hands with respect to the body of the stringed musical instrument. The methods of detection include the method utilized by the musical instrument device known as the Theremin.

Defining an Instrument by Mapping Technique Command Signals to Control System Behaviors.

In some embodiments, a control mapping matrix is bounded on one axis by all possible technique-derived control command signals and along the other axis by all possible system behavioral inputs. Using a Setup Utility software, selected functions or "scripts" can be inserted at any subset of cross points in the matrix for the purpose of establishing the relationship between particular command signals and particular behavioral inputs. The mapping and scripts of all such elements together with sets of reference waveforms and spectra constitutes an "instrument definition." For example, an instrument definition of a guitar would be one set of waveforms, spectra and scripts and a banjo would have another.

Instrument Definition Design Utility Software

In some embodiments, the instrument may be set up rather than played, and a Set-up Utility computer program or on any suitable external computer connected through a communication link enables a manufacturer or instrument designer to define the character and behavior of a particular model or brand of an instrument employing embodiments according to the invention. The behavior is established by prescribing the assignment and interrelationship of the various technique-derived command signals and by supplying and storing unique reference spectra within the electronics according to embodiments of the invention. Thus, one manufacturer who develops a product for sale that employs embodiments according to invention can differentiate his product from all others by developing his own prescription for control behaviors and endowing the instrument with his own choice of sounds, all without modifying a standardized hardware apparatus of the device.

Use with Known Sustain Systems

Reduced but still novel and musically useful functionality is obtained by coupling the "Recognition of Technique" according to some embodiments of the invention with existing sustainer systems.

In some embodiments of the invention, a control signal representative of vibrato could be used to control the amount of sustain delivered to a string by a conventional sustain system such as the sustainer described in U.S. Pat. No. 5,233,123 provided that this sustainer was modified to accept such a control signal input governing its sustain action.

All such uses are within the scope of the present invention as would be understood by one of ordinary skill in the art.

Additional User Interfaces

Some embodiments of the invention accept, via an auxiliary user interface connection, mode or behavioral control signals from an auxiliary user interface.

Plurality of Instrument Definitions

In some embodiments of the invention, a plurality of instrument definitions is stored within the each instrument. A change of mode may be used when changing from one definition to another. This is conceptually analogous to putting down one instrument and picking up another.

Computer Interfaces

In some embodiments of the invention, internal states of an instrument may be downloaded, stored and/or uploaded. Such state records can be stored, examined and edited on a computer. Aspects of the instrument's behavior can be customized in this way. Another use of this facility is to transfer instrument definition settings from one instrument to another, or simply to back up the settings in case the electronics of the instrument fail or the instrument is lost or stolen.

In some embodiments of the invention, an external computer interface has the capability of downloading replacement computer and digital signal processing executable computer code for some or all internal programs. This code-downloading feature makes it possible to correct programming errors and to advance the art of the electronics without having to change physical components within the instrument. In some embodiments, a kernel of persistent code that cannot be overwritten provides this basic communication and code download functionality.

Audio Interfaces

In some embodiments, audio input and output is handled both as an analog signal and in standard digital formats.

Orthogonal Transducers

In some embodiments of the invention, there may be two transducers coupled to each string of the instrument, where the transducers are arranged so that a string vibration in a plane parallel to the face of one transducer will be normal to the face of the other, and this arrangement provides for improved control of all string vibrations. This and other combinatorial variations and arrangements of transducers are within the scope of the instant invention.

External Audio Signal as a Spectral Reference

In some embodiments of the invention, there are one or more audio inputs that accept either analog signals or signals in a standard digital form. Any audio signal, including sounds from any synthesizer, can be applied to such inputs. The spectra of these audio inputs are continuously extracted using Fourier transform methods and can optionally serve as a "live" or "real time" spectral references, allowing for example an instrumentalist's voice to control the timbre of the instrument. When an audio input is present, it automatically overrides other spectral references.

Physical Deployment in an Instrument

The electronics for implementing methods and systems according to some embodiments of the present invention may be incorporated and/or integrated with an acoustic instrument or solid body instrument so as to create a new instrument that to the player seems as a unified whole rather than as an instrument with attached electronics. An electronic subsystem containing some or all of the functions according to some embodiments of the invention may replace the bridge and saddle of a conventional instrument. If needed, a second subsystem according to some embodiments of the invention may be housed inconspicuously within the instrument body.

Accordingly, systems and methods for modifying the vibration of at least one string (and in some embodiments, each string) of a stringed instrument in response to preselected player techniques involving selected characteristic features of the string's motion according to some embodiments of the invention include, at least one transducer coupled to the string for providing a sensing output signal in accordance with the motion of the string and at least one transducer for effecting a change in the string motion in accordance with an actuating signal. At least one actuating transducer drives the string by moving or vibrating the point of termination of string vibration in either or both the transverse and the longitudinal direction. The sensed output signals are stored in a memory to provide a history of the string's motion and features of such motion are extracted. A supervisory system reviews the extracted features to determine when the features substantially correspond to one or more preselected player techniques. In response to the recognition of a preselected player technique(s), the supervisor provides a control signal to a controller, which in response thereto applies an actuating signal to the transducer to modify the string's motion in accordance with the recognized technique. For example, a set of pattern matching rules representative of string motion associated with the preselected player techniques allows the extracted features to be tested against the rules. A programmer may establish and record the rule set, e.g., at a manufacturing site, or the rule set may be generated and recorded by the supervisory system during a training session depending upon the processor architecture employed. The preselected player techniques may include vibrato, glissando, etc. Additionally, a waveform server may be provided for supplying excitation waveforms to the controller, and the supervisory system may provide for storage and retrieval of spectral templates as well as a general storage for retaining system data. A battery, or fuel-cell and recharger, or wire connection and/or other suitable device for supplying power to the system may be included. Analog and digital data and audio inputs and outputs may also provided for connecting the instrument to other electrical devices such as an external user interface device, computer or an audio amplifier.

Routine aspects of software and hardware known to one with ordinary skill in the art of designing digital signal processing systems as being necessary to the functioning of such software and hardware systems are not described herein. As a partial example, such things as software stacks, buffering and scaling amplifiers, hardware clocks, memory controllers, clock sources, DMA, etc., are known and not shown or described herein for clarity. Conversely, wherever ordinary details are included herein, it is done for clarification and does not impose a duty to include such details according to some embodiments of the invention.

Aspects of the control systems used in some embodiments of the instant invention are described in U.S. Pat. No. 6,216,059. U.S. Pat. No. 6,216,059 discloses signal processing to extract spectra from a string's motional signal, to compare the spectra to a reference spectra, and to adjust a control function to compel the string's motional spectra to match the reference spectra.

U.S. Pat. No. 5,233,123 provides an extensive examination of basic sustainer technology and the contents thereof is incorporated herein by reference.

U.S. Pat. No. 3,813,473 shows an early sustainer system using mechanical feedback and the contents thereof are also incorporated herein by reference.

The Supervisor

Systems and/or methods according to some embodiments may be used for recognizing the intentions of an instrumentalist and responding in the form of specific control system behaviors (known herein as the "supervisory system," "supervisor unit" or "supervisor"). The supervisor captures information from all strings of the instrument over time and governs the actions and behaviors of all the individual motion controllers according to the instrumentalist's intent.

The Transducers

Transducers may be illustrated herein as simple solenoids; however, it is understood that any suitable transducer type, shape and/or configuration may be substituted for the transducers shown herein and shall fall within the scope of the invention.

Control Laws

Some embodiments of the invention include the identification of a mathematical control law for the transverse control function that is suitable for controlling individual harmonics of lateral string vibration. It is possible to apply direct velocity feedback and also possible to use a PID control or any other known control law. The basic control law for transverse control giving the change in position Y of the string termination is:

$$Y=g\times p' \qquad \text{control law [1]}$$

where p' is the velocity in the transverse Y axis of a point on the string and g □ is a coefficient describing the control gain.

In some embodiments according to the invention, a mathematical control law for the tension control function that is suitable for controlling individual harmonics of lateral string vibration is identified. Previous published research in this area, now public, (See VOL. SEPTEMBER-OCTOBER 1984 SPACECRAFT issue 463, "Response of Large Space Structures with Stiffness Control," Jay-Chung Chen), has identified the feasibility of controlling lateral vibration using tension modulation but has concentrated on the control of one single harmonic mode of vibration at any one time.

The basic controller follows from the idea that a transverse wave in a vibrating string at a single frequency can be damped by modulating the tension of the string at double the frequency of vibration [5]. To drive the string the change in tension T of the string may be proportional to the displacement of the standing wave times the velocity of the standing wave. The displacement and velocity should be measured at the same point p anywhere along the length of the string. The basic control law for tension control is, $$T=g\times p\times p' \qquad \text{control law [2]}$$

where p is the displacement of a point on the string, p' is velocity the derivative of displacement p, and g □ is a coefficient describing the control gain. For sustaining instead of damping vibrations the same control law may be used, but g□ is inverted in polarity. This control law operates under the assumption that the tension is always uniformly distributed across the length of the string but for higher harmonic frequencies this may not be so. In that case a high-frequency roll-off to the control gain may be used. Control behavior is improved by tightly compressing the amplitude of the actuation signal T so that it fits the available range of actuation, but also limiting the gain to values that ensure control system stability. For example, if the compressor holds the level of the actuation signal approximately constant, then the harmonic vibrations will decay or grow approximately exponentially over time.

The computational steps to realize this control function are: integrating a sensed signal representing the velocity of lateral string vibration to produce a displacement signal, calculating the product of the velocity signal and the displacement signal and scaling the resulting actuation signal to fit the available range of actuation, i.e., compressing the signal. The actuating signal then drives an actuator to modulate string tension, thus completing the control loop.

In some embodiments according to the invention, difficulties with tension modulation when controlling multiple harmonic modes of vibration are addressed. String tension varies as the square of lateral string displacement and in the presence of more than one harmonic undesirable intermodulation distortion occurs in control law [2]. Intermodulation distortion can be shown to destabilize the control system making it less practical. Some embodiments of the invention present a strategy that avoids intermodulation by using band pass filters to separate a sensed lateral vibration velocity signal into its individual harmonic components. Each component is integrated to produce a corresponding displacement signal, then control law [2] is applied multiple times to calculate the change in tension for controlling each harmonic. All of the resulting individual harmonic tension actuation signals T are summed into the final actuation signal used to modulate the string tension. In this case, the computational steps are: separating a sensed signal representing the velocity of lateral string vibration into its constituent harmonics, calculating the integral of each individual harmonic constituent to produce a corresponding set of displacement constituents, calculating the product of each pair of constituents where the first of the pair represents the instantaneous velocity of a harmonic and the second of the pair represents the corresponding displacement, scaling, polarizing and summing all of the products together forming an actuating signal of a selected polarity having energy proportional to the summation. This actuation signal is amplified to drive an actuating transducer to cause a change in the tension of the string.

The band pass filters may be the same type of band pass filters that separate a velocity signal into individual harmonics as described in U.S. Pat. No. 6,216,059. In some embodiments of the invention, the band pass filters serve two purposes, one to improve the behavior of the control law by avoiding intermodulation, and the other to control the amplitude of selected harmonics, for which it is necessary only to set the gain coefficient g for each individual filter as needed to compel and constrain the spectrum of string vibration towards the specified spectral reference signal.

Figure 1:
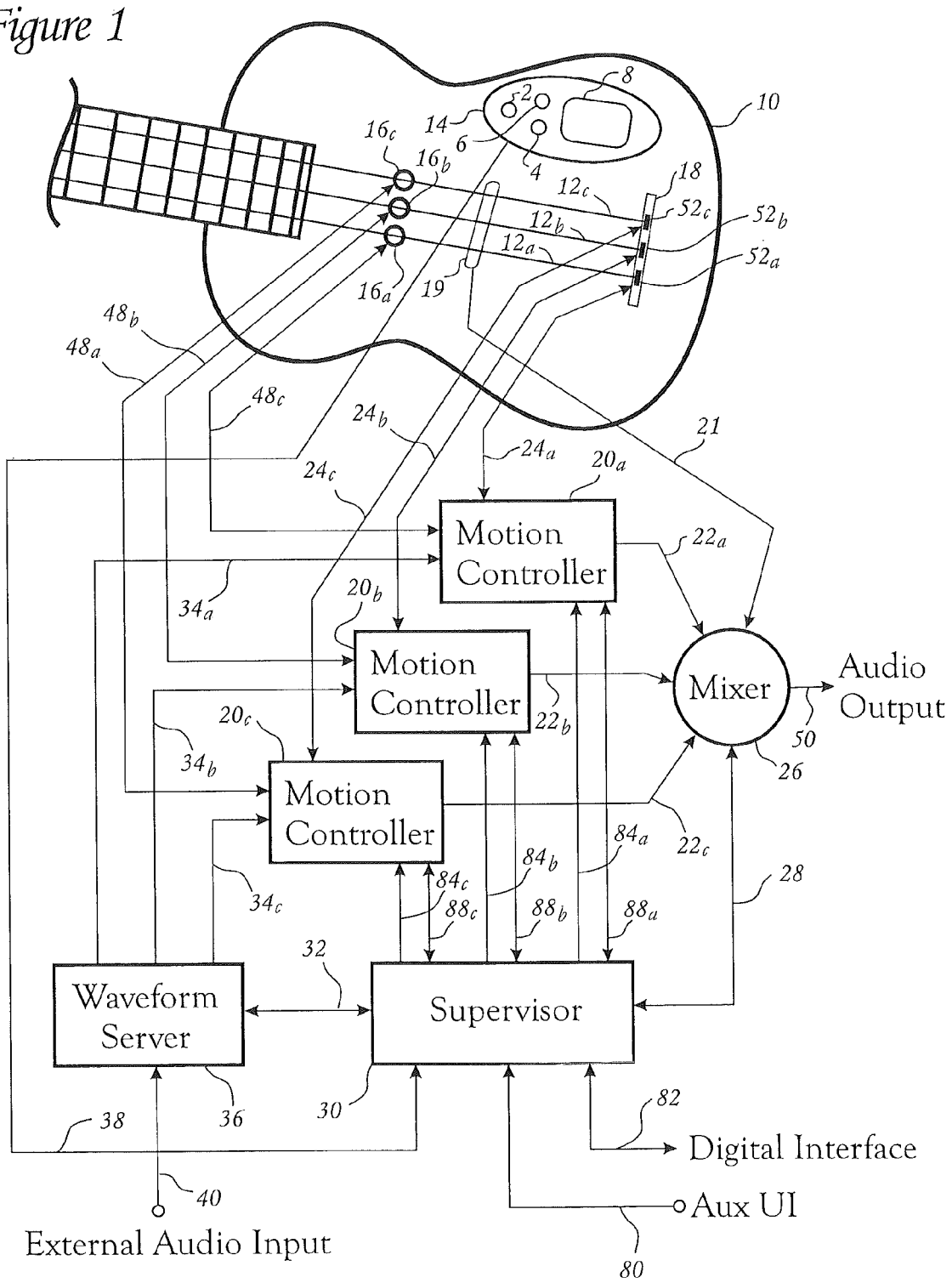
FIG. 1 is a schematic diagram of a guitar-like stringed instrument according to some embodiments of the invention.

Embodiments of the invention are illustrated in FIG. 1. Guitar 10 is shown as having three strings 12*a-c* but it could have any number of strings 12. Taut musical instrument strings 12 are anchored at bridge 18 and terminated by individual saddles 52*a-c*. An individual transducer 16 is provided for each string and may contain any type of transducer responsive to the string's motion or position. User controls 14 are positioned on the instrument for convenient access and can be of any suitable type including a capacitive, resistive, inductive or optical touch surface and/or proximity sensor 8 and rotating or sliding controls or switches 2, 4, 6, etc.

As illustrated in FIG. 1, interconnection lines represent the flow of information but are not necessarily physical connections. Communication lines are shown for conceptual clarity as proceeding from one function block to another whereas the actual paths of such information may differ from that shown in FIG. 1.

Bridge 18 orients and secures saddles 52*a-c*. For each string 12 a saddle 52 terminates a string 12 and is arranged to drive the position of the termination transversely and or longitudinally. The bodies of saddles 52 are hidden by the top surface of bridge 18; see FIG. 2 for a full view of a saddle 52. Transducer 16*a* is associated with string 12*a* and so forth. Transducers 16 are connected to motion controllers 20 via lines 48 and provide signals from which the individual string velocities and positions can be extracted. In dual control systems utilizing velocity control, lines 48 also carry actuator drive signals from motion controllers 20 to the transducers 16, which in velocity control embodiments are electromagnetic sensor/actuators as described in the U.S. Pat. No. 6,216,059. Each motion controller block 20 contains at least one motion controller. Block 20 contains two controllers in some embodiments and may in some embodiments contain three or more controllers.

Motion controllers 20 are connected to saddles 52 via lines 24, each of which transmits one or more drive signals to one or more saddle actuators and, in some embodiments, provides information back to motion controllers 20 to enable closed loop control of saddle position. Motion controllers 20 extract and route audio signals from sensors 16 to mixer 26. Motion controllers 20 are responsive to commands via line 88 and frequency domain data 84 from supervisor 30 which controls their behavior according to the intent of the musician player as expressed through a player's actions upon user interface 14 or as expressed through a player's actions upon the strings themselves. Motion controllers 20 are also responsive to time domain waveform data 34 from waveform server 36 which is also controlled by supervisor 30 via data line 32 and responsive to the frequency domain data on lines 84.

The waveform server 36 delivers specified time domain waveforms to the time domain reference inputs of motion controllers 20. The waveforms may be prerecorded or synthesized by server 36 as needed, or they may be provided externally over audio Path 40.

The sensors 16 are shown some distance away from bridge 18 but may be located at any point along the strings including a point very close to bridge 18.

In the mixer 26, audio signals 22 are selected and mixed with an optional signal 21 from an optional conventional musical instrument pickup 19 and an optional signal 28 from the supervisor 30 to produce electrical output signal 50. The signal 50 may be a mono, stereo or multi-channel signal containing audio in analog or digital form representing each or all strings 12 and may also include time domain data from waveform server 36. The mixer 26 routes instantaneous waveform data 22 and 21 for storage in memory 250 of the supervisor (see FIG. 9).

FIG. 1 illustrates three combinations of controllers in a dual control system according to some embodiments of the invention. The motion controller 20 can be internally arranged to drive the strings 12 laterally using velocity control via electromagnetic sensor/actuator transducers 16 and combined first with transverse control or second with tension control of saddles 52. A third combination is tension control combined with transverse control, in which case transducers 16 are sensors and may be of any type including electromagnetic, ultrasonic, or optical.

Figure 2:
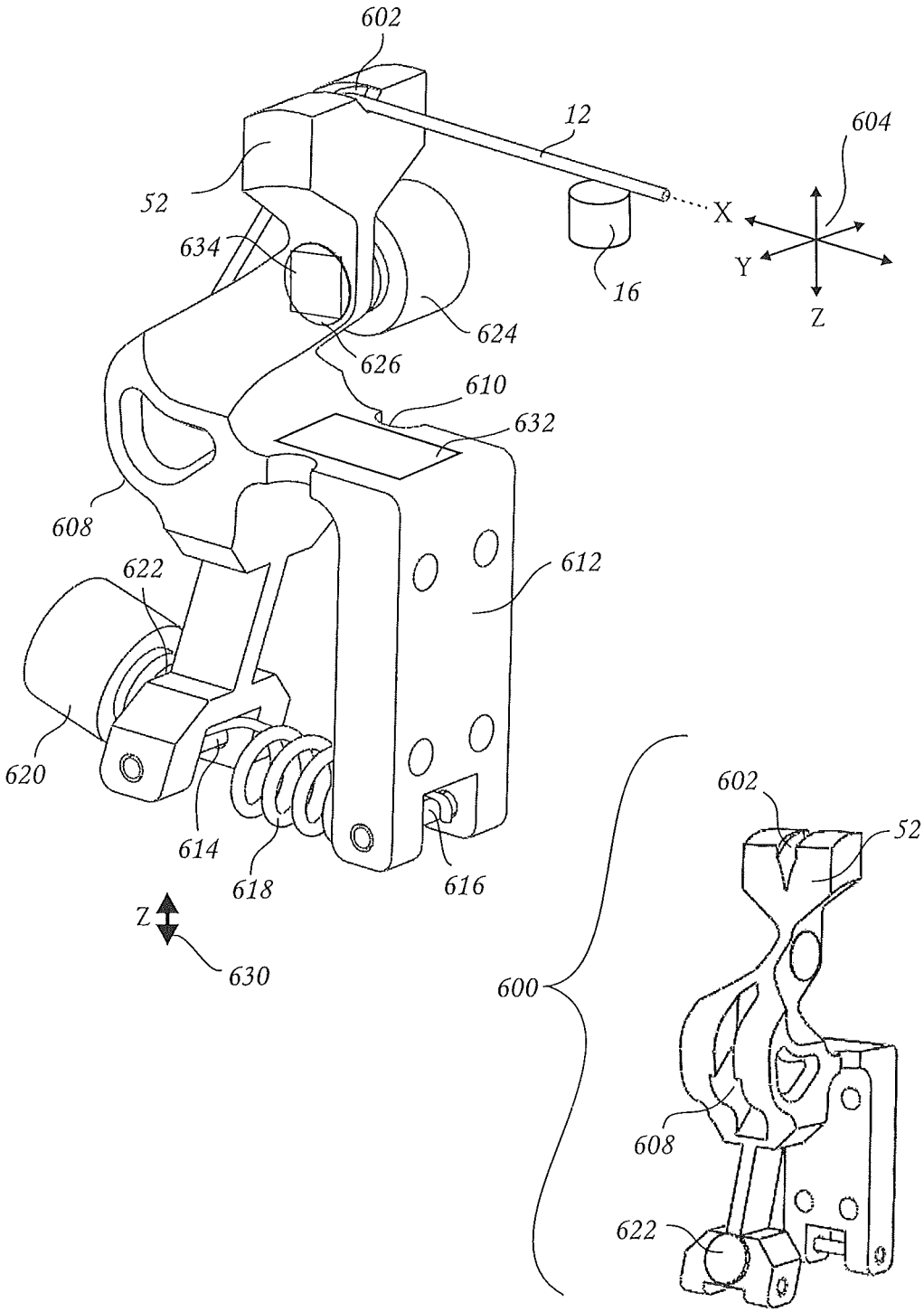
FIG. 2 is a saddle assembly for a stringed musical instrument in which the string may be driven longitudinally and transversely according to some embodiments of the invention.

Referring to FIG. 2, a lever-shaped saddle 52 is a saddle modified to allow the termination point of the string to be moved longitudinally and transversely. Coordinate symbol 604 defines three axes X, Y and Z with X aligned to the axis of string 604. At the approximate middle of the saddle 52 is a pivot feature 610, a narrowed region that joins the lever arm saddle 52 to the fixed portion of saddle 52 and either mechanically pivots or flexes sufficiently to serve as a pivot, allowing a small rotation of the saddle 52 on the XZ plane to produce the longitudinal motion of the string termination point. A pivot 610 is anchored at a mounting flange 612 which must be rigidly fixed in relation to the body and neck of the instrument 10. The lower end of the lever portion of the saddle 52 is provided with a connection feature 614. A spring 618 is at one end connected to the feature 616 which is also fixed in relation to the body and neck of the instrument 10 at a mounting face 612. The feature 616 may include a suitable tension adjustment mechanism to adjust the spring tension (not shown). The other end of spring 618 is connected to the saddle 52 at the feature 614. In operation, the tension of the spring 618 balances the tension of the string 604 with the saddle 52 acting as a lever against the pivot 610.

An inset view 600 of FIG. 2 illustrates the saddle 52 from a different direction for clarity of certain features.

Referring to FIG. 2, along the vibrating portion of the string 12 from right to left, the string 12 is terminated as it enters the saddle 52 at string terminator groove 602. The string is anchored to the saddle 52 at trap 608, which is illustrated in FIG. 2 as a feature shaped to trap and secure the ball-end of a musical instrument string.

The actuator 620 is secured immovably in relation to the body and neck of the instrument and applies an actuating force against a force receptor 622 in the X direction, upsetting the balance between the tension of the string 604 and the spring 618 and causing the string termination point at the saddle groove 602 to move longitudinally along string axis X. The actuator 620 and the force receptor 622 may, in some embodiments, be located at the upper portion of the saddle 52 where the actuator 620 and the force receptor 622 would operate to the same effect, although the polarity of the signal driving the actuator 620 would be reversed.

The actuator 624 is secured immovably in relation to the body and neck of the instrument 10 and applies an actuating force against the force receptor 626 in the Y direction, causing the stem of the saddle 52 in the vicinity of the receptor 626 to flex and causing the pivot 610 to twist and thus moving the string terminator groove 602 in the Y direction.

The actuator 624 and the actuator 620 are electromagnetic actuators each including a coil of wire and a source of magnetic field such as a permanent magnet. The magnetic field source and the coil can be arranged in any way that results in a force between the actuator and the force receptor in the Y direction for the actuator 624 and the X direction for the actuator 620. For example, a magnet may be mounted to the force receptor to move in relation to the coil, or the coil may be mounted to the force receptor to move in relation to the magnet, or the coil may operate without a magnet as in a solenoid device, etc. The actuator 624 may include two segments mounted on either side of the force receptor 626 and driven to push it first one way and then the other on the Y axis. Being coupled magnetically, but not physically coupled to the saddle 52, the actuator 624 is unaffected by the longitudinal motion of the saddle 52, and the actuator 620 is similarly unaffected by the transverse motion of the saddle 52.

The force receptors 622 and 626 are immovably connected to the saddle 52. In some embodiments, electromagnetic actuators force receptor 622 and 626 are ferrous and may be a small ferrous plate attached to the saddle 52 or a defined region of the saddle 52 if the entire saddle 52 is constructed of a ferrous material.

In some embodiments, the actuator 624 and/or the actuator 620 may be piezoelectric stacks or magnetostrictive actuators. In this case, each such actuator may be adapted to yield with respect to the body of the instrument along the direction driven by the other actuator to reduce potentially destructive shear forces from arising within such actuators.

In some embodiments, the actuator 620 is omitted and replaced by a piezoelectric bending actuator 632. The flexible pivot 610 may be a pivot point for rotational motion or vibration of the saddle 52, which translates to longitudinal motion of the string termination groove 602, thereby modulating the tension of the string 12. A piezoelectric bending actuator 632 may be bonded to flexible pivot 610 and generates the same rotational motion of saddle 52 by directly forcing flexible pivot 610 to flex in generally the same manner. When the bending actuator 632 is not energized, it is at rest and the string tension is balanced by the spring tension. When driven by a voltage, the piezoelectric bending actuator 32 upsets that equilibrium balance. The amount of force used to upset the equilibrium balance may be a small fraction of the total tension of the string and the spring and is within the range of force of currently available commercial piezoelectric bending actuators. In some embodiments, the force receptor 626 is replaced by piezoelectric bending actuator 634 arranged to bend the stem of saddle 52 in the Y direction, in which case the actuator 624 is omitted. In summary, piezoelectric bending actuators substituted for the electromagnetic actuators 620 and 624 and act to produce substantially the same effects upon the saddle 52 and the string termination groove 602.

A third actuator 630 coupled to a third controller could be deployed to drive the saddle 52 along the Z direction by appropriate flexing of the pivot 610, and the Z axis lateral vibration of the string 12 may also be controlled by any combination of actuator/control systems.

Sensors

The actuator control system configurations discussed herein may use at least one input signal, for example, from a transducer 16 responsive to either the lateral position of the string 12 or the lateral velocity of the string 12. The transducer 16 is positioned along the length of the string 12, such as at a position where all of the harmonics of interest are manifest, usually 1 to 2 cm along the string 12 close to the saddle 54. At this position, the transducer 16 approaches collocation with the string termination actuator, which may be desirable for transverse control.

As illustrated in FIG. 2, certain features such as the introduction of voids to reduce mass, providing mounting holes and thinning of the part to allow flexibility in selected directions of motion may be used, and additional workshop variations and refinements are possible and are included within the scope of the invention. Exemplary modifications include but are not limited to providing stops to limit the range of rotation of the saddle 52 about the pivot 610 to a nondestructive range and selecting materials for constructing the elements of some embodiments of the invention having advantageous properties, in particular, such as forming all of the saddle 52 or at least the flexible pivot 610 out of spring steel.

Accordingly, as illustrated in FIG. 2, the saddle 52 is provided for terminating the vibrating portion of the taut musical instrument string 12 and for anchoring the string 12 to support the string's tension. The point of string termination 602 may be driven to move or vibrate longitudinally along the string axis to modulate the tension of the string 12, and or transversely to directly drive the lateral vibration of the string 12. The saddle assembly includes a string 12, a lever portion of saddle 52, a spring and a pivot 610, the lever depending at its center from the pivot 610, one free end of the lever being formed into a musical string saddle termination groove 602 for anchoring and terminating one end of the vibrating portion of the string and the other free end of the lever being attached to the spring. The pivot in the spring 618 may be solidly attached to the instrument bridge assembly such that the tension of the string 12 is balanced across the lever and against the pivot by the tension of the spring 618, so that the lever is at equilibrium. An actuator 620 or 632 is arranged to drive the saddle lever to upset the equilibrium of the spring 618 and the string 12 in accordance with an actuation signal thereby to move or vibrate the position of the point of string termination longitudinally, and the actuator 624 or 626 is arranged to move or vibrate the point of string termination transversely.

Figure 3:
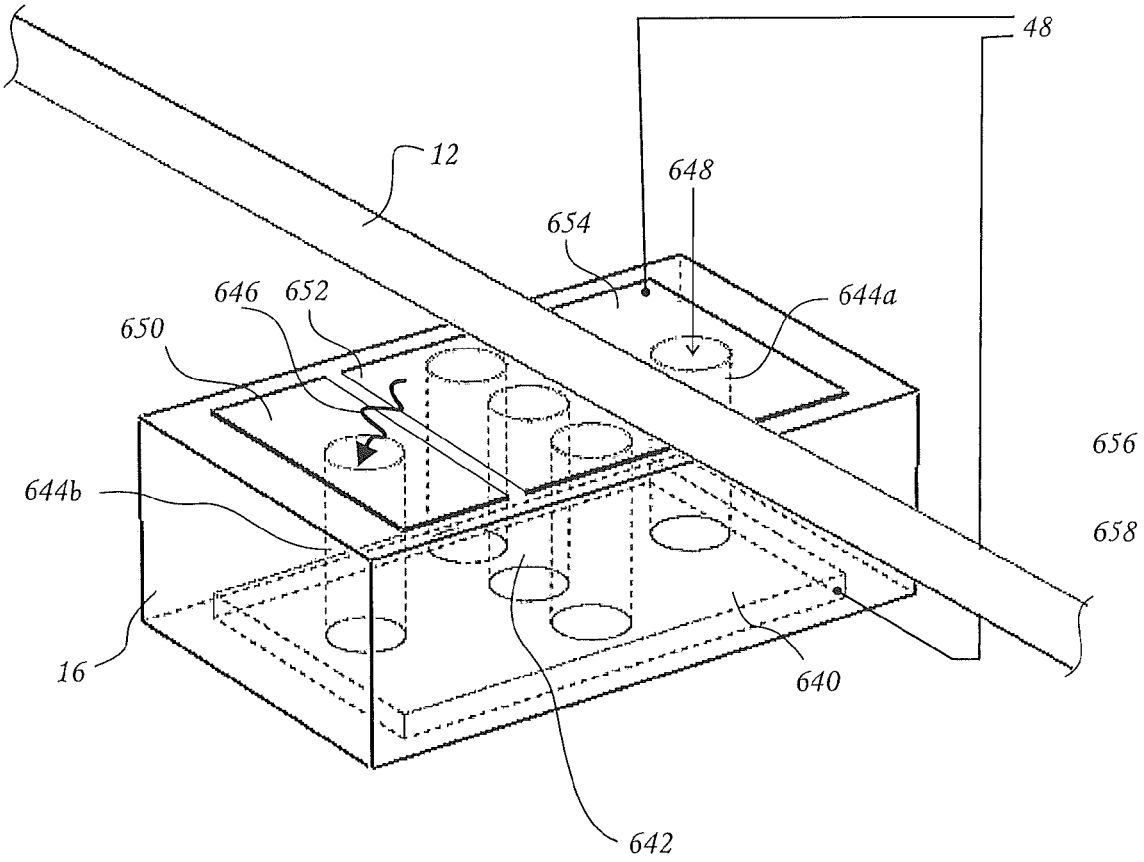
FIG. 3 is a schematic diagram of an ultrasonic sensor responsive to the motion of a musical instrument string according to some embodiments of the invention.

FIG. 3 illustrates sensing device including an ultrasonic emitter and ultrasonic sensors suitable for sensing the vibration of a string made of any material including a nylon string. A transducer 16 is configured as a circuit for sensing the motion of a taut musical instrument string 12 and incorporates at least one emitter of ultrasonic vibrations 642 and at least one ultrasonic sensor 644 arranged to receive ultrasonic vibrations reflected by the string 12. The transducer 16 is positioned some distance from the saddle (shown in FIG. 2) along the vibrating string 12 and oriented so that ultrasonic emitter 642 is positioned directly below the string 12. An emitter 642 emits ultrasonic waves which impinge upon and are reflected by the string 12. The sensors 644*a* and 644*b* are arranged to be responsive to the ultrasonic waves 646 reflected from the string 12 but not to the ultrasonic waves directly emitted by the emitter 642. The mean path between sensor 644*a* and the string 12 is arranged to be at a right angle to the mean path between the sensor 644*b* and the string 12 so that the sensor 644*a* responds to string vibrations in a first plane and the sensor 644*b* responds to string vibrations in a second plane, the first plane being rotated about the axis of the string 12 by approximately 90° with respect to the second plane.

The ultrasonic elements 642 and 644 may be of any suitable type such as piezoelectric, electromagnetic or electrostatic. In some embodiments, resonating cavity electrostatic elements are employed. Electrostatic elements may be formed in a substrate, and such as printed circuit board material, by drilling blind holes 648 down to a level of metallization 640 in a substrate to form a cylindrical tuned cavity and a first electrode 640 at the lower face of each cylindrical cavity that provides both an electrode connection and acoustic termination of the cavity. Conductive elastic membranes 650, 652 and 654 are adhered on the top surface of the substrate and provide a second electrode at the top face of the cavity. FIG. 16 is not to scale; the actual features involved are small compared to the diameter of a string. The ultrasonic frequency may, for example, be in the range of several megahertz for the wavelength to be short enough to be reflected by the string 12. The geometry of the emitters 642 and the sensors 644 is identical; all the cavities are tuned to substantially the same frequency of resonance, and the sensor cavities 644 readily respond to reflected ultrasonic waves emitted by the generally identically shaped cavity of the emitter 642. In some embodiments, the emitter 642 may not include a single element but rather an array of generally identical elements each formed as described and driven to produce a directional ultrasonic beam. An array of three emitters is illustrated with numbered emitter 642 being the middle elements of the array. The emitter is driven by an oscillating voltage signal connected between membrane 652, and the metallization 640 at the lower face of the cavities. This drives the membrane electrostatically at the natural frequency of the cavity or a harmonic thereof. A charge is maintained between the sensor electrodes 640 and 650. Ultrasonic waves impinging upon the membrane of the top electrode caused it to flex and thus modulate the capacitance between electrodes. The electrode charge is generally constant; therefore, any modulation of the geometry of the capacitance produces a voltage signal representing the ultrasonic waves reflected from the string 12.

When the string 12 is vibrating, the frequency of the ultrasonic waves is Doppler shifted according to the velocity of the reflection point on the string 12. The cavity output signal 656 is processed to measure the Doppler shift and becomes the sensor signal 48 representing the velocity of string motion. The Doppler shift may be measured according to techniques known to those of skill in the art.

Figure 4:
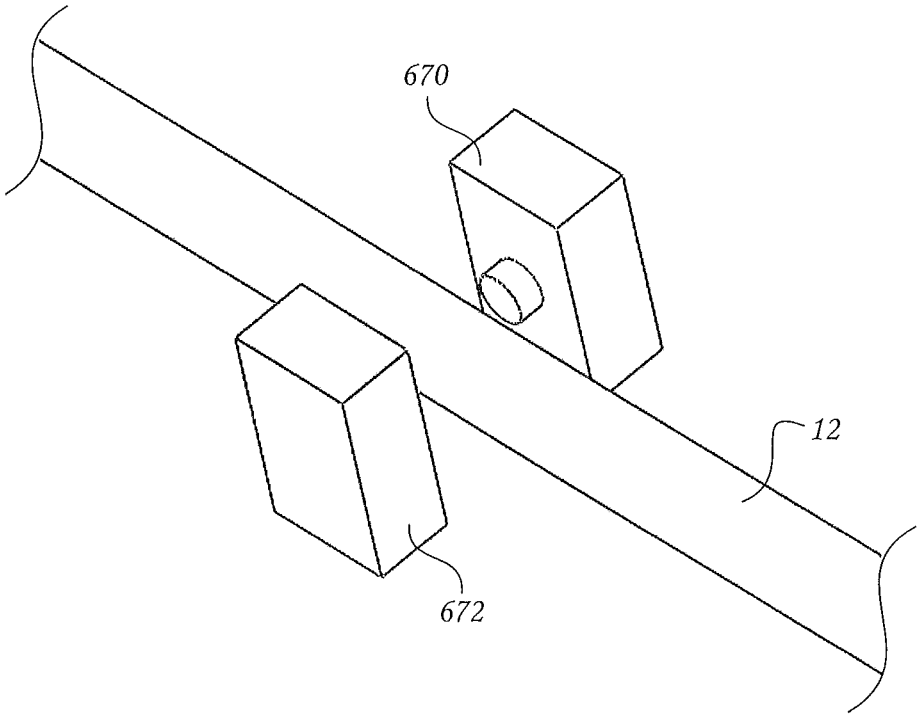
FIG. 4 is an optical motion sensor that is responsive to the motion of a musical instrument string according to some embodiments of the invention.

FIG. 4 illustrates a sensing device including an optical emitter and optical sensors that are suitable for sensing the vibration of the string made of any material including a nylon string. An optical emitter 670, a LED or a laser diode, illuminates the string with light that is modulated at a supersonic frequency. A string 12 interferes with the transmission of this light across to an optical sensor 672. As the string 12 vibrates, the amount of light being transmitted is variably occluded by the string 12 resulting in a signal at the sensor 672 representative of string position. Differentiating this signal yields string velocity.

Figure 5:
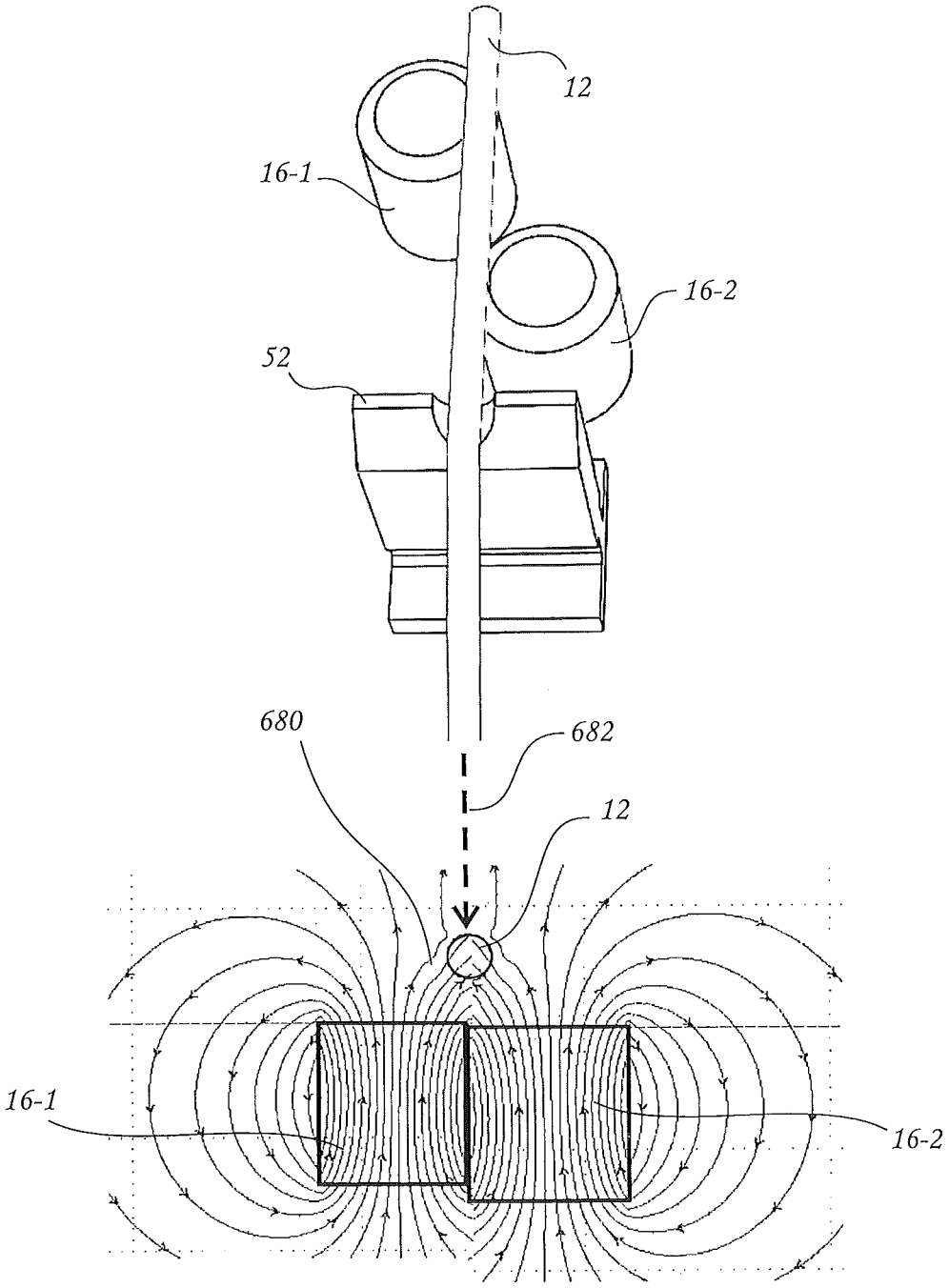
FIG. 5 is an electromagnetic transducers capable of interacting with string vibration on more than one axis of lateral vibration according to some embodiments of the invention.

FIG. 5 illustrates electromagnetic transducers 16-1 and 16-2, which can serve a variety of roles in some embodiments of the invention. As velocity sensors, the transducers 16-1 and 16-2 behave much like conventional guitar pickups and produce a voltage representative of the velocity of the vibration of the string 12.

The transducers 16-1 and 16-2 may also be employed as sensor/actuator transducers such that a controller is as presented in U.S. Pat. No. 6,216,059. In this case, the transducers 16 are connected to a controller, such as the controller in U.S. Pat. No. 6,216,059, and serve as sensors and actuators; the sensing time channel output of the controller also provides the velocity signal of lateral string motion and may be used by a second controller, such as a tension control and/or a transverse control.

FIG. 5 illustrates two electromagnetic transducers 16-1 and 16-2 that are arranged to couple a magnetic force to a string vibration along orthogonal axes without having to rotate the transducers 16-1 and 16-2 themselves around the axis of the string 12. The illustration shows the string 12 passing slightly to the right of the transducer 16-1 and slightly to the left of the transducer 16-2. The transducers 16-1 and 16-2 are spaced along the string 12 sufficiently so that their individual magnetic fields are not completely merged and are able to operate along their individual fields vectors. Following the dashed arrow 682, the bottom part of FIG. 5 illustrates a simulation of the magnetic field lines of force 680 by transducers 16-1 and 16-2 presented from the viewpoint of looking down into the axis of the string 12, which appears in cross-section at the end of the arrow 682. The lines of force 680 are seen to intersect the string 12 at a 45° angle when coming from the transducer 16-1 and at a mirrored 45° angle when coming from the transducer 16-2, thus forming a 90° angle with respect to the string 12. This shows that when the transducers 16-1 and 16-2 are arranged as illustrated, the transducer 16-1 will respond to one plane of vibration while the transducer 16-2 responds to a second plane of vibration that is rotated approximately 90° around the axis of the string 12. It is of note that the transducers 16-1 and 16-2 do not need to be themselves rotated to achieve this but can instead be mounted upright and merely displaced as shown.

Figure 6:
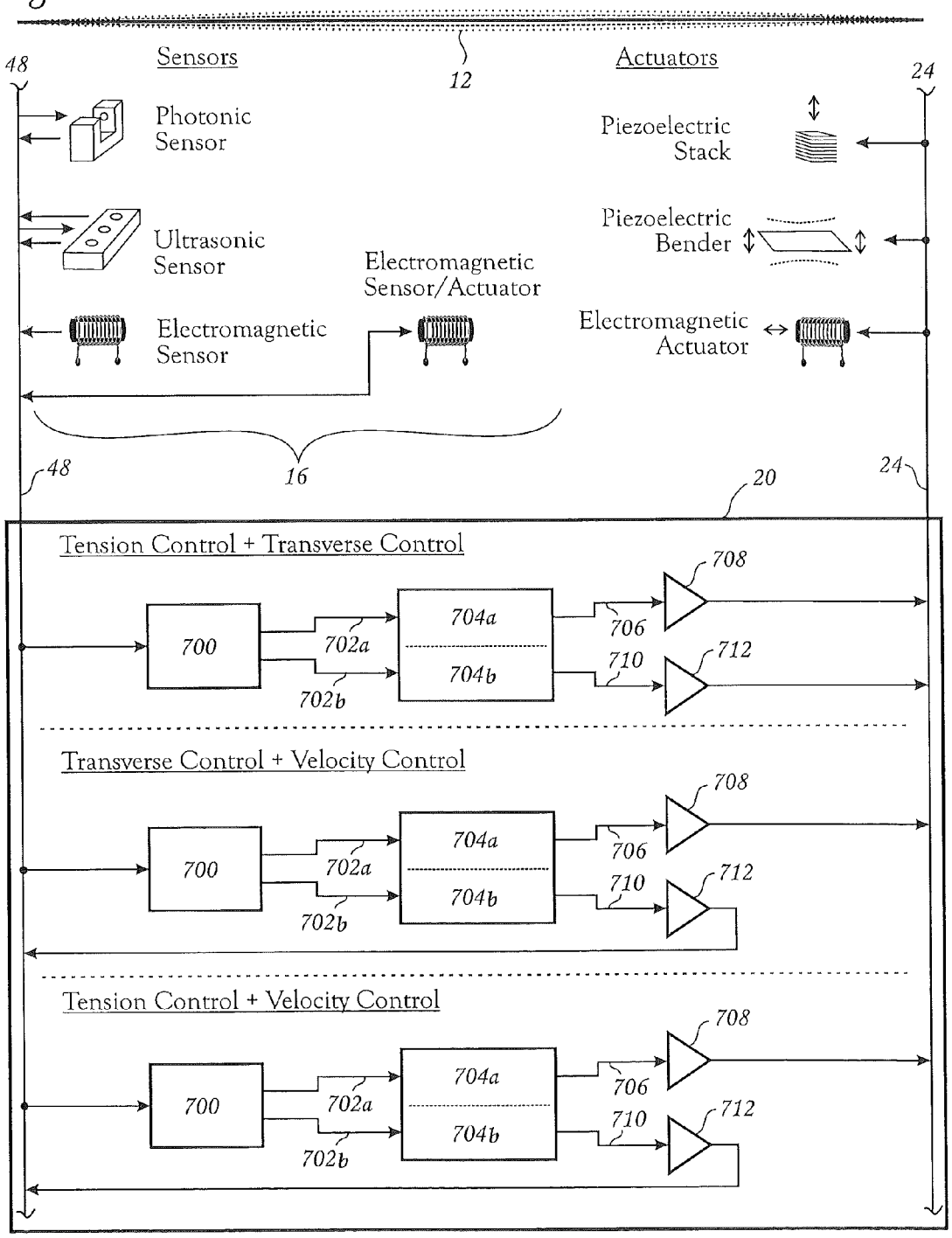
FIG. 6 is a schematic diagram of the signal flow and functional blocks of the dual control systems according to some embodiments of the invention.

FIG. 6 illustrates dual control systems according to some embodiments of the invention. The transducer 16 may be any suitable transducer, including photonic, ultrasonic, and electromagnetic transducers. The transducer 16 may also be an electromagnetic sensor/actuator.

The saddle 52, (see FIGS. 1 and 2), terminates a string 12 and drives the termination point with a suitable actuator including, but not limited to, a piezoelectric stack, a piezoelectric bending actuator and/or an electromagnetic actuator.

The motion controller 20 is responsive to a sensor or a sensor/actuator transducer via the line 48 and drives an actuator via the line 24, and in the case of a sensor/actuator via the line 48. The data lines 84, 88, 34 and 22 of the motion controller 20 are omitted from FIG. 6 for clarity and ease of representation.

In FIG. 6, the control block 20 is illustrated as containing three exemplary variants of the dual control system.

In some embodiments, a sensor signal conditioner 700 processes signals from a sensor, such as a photonic, ultrasonic, or electromagnetic sensor, into a signal representing the velocity of string vibration and provides it as a signal 702. Depending on the type of sensor used, the signal 702 may be split into signals 702*a* and 702*b* representing the velocity of string vibration on orthogonal planes. When velocity control is used, signal conditioner 700 operates in the manner described in U.S. Pat. No. 6,216,059 to extract a velocity signal from the transducer during a sensing portion of a time frame. The signal conditioner 700 performs analog to digital conversion in some embodiments.

In some embodiments, the processing block 704 produces actuating signals 706 and 710 that are amplified by drivers 708 and 712, which connect to and drive actuators. In some embodiments, the drivers 708 and 712 contain pulse width modulators which may be either continuous or discontinuous and which are arranged to efficiently drive actuators.

In some embodiments, tension control and transverse control may be utilized, and the processing block 704 contains two controllers. The process 704*a* applies control law [1] to produce an actuating signal 706 for an actuator that moves or vibrates the string termination transversely. The process 704*b* applies control law [2] to produce actuating signal 710 for an actuator that moves or vibrates the string termination longitudinally and modulates string tension.

In some embodiments, transverse control and velocity control may be used, and processing block 704*a* applies control law [1] to produce actuating signal 706 for an actuator that moves or vibrates the string termination transversely. The process 704*b* produces an actuating signal 710 that is amplified by a driver 712 and is applied via line 48 to the electromagnetic sensor/actuator during the actuating portion of a time frame.

In embodiments of dual control systems utilizing tension control and velocity control, processing block 704*a* applies control law [2] to produce actuating signal 706 for an actuator that moves or vibrates the string termination longitudinally. The process 704*b* produces an actuating signal 710 that is amplified by the driver 712 and is applied via line 48 to the electromagnetic sensor/actuator during the actuating portion of a time frame.

Figure 7:
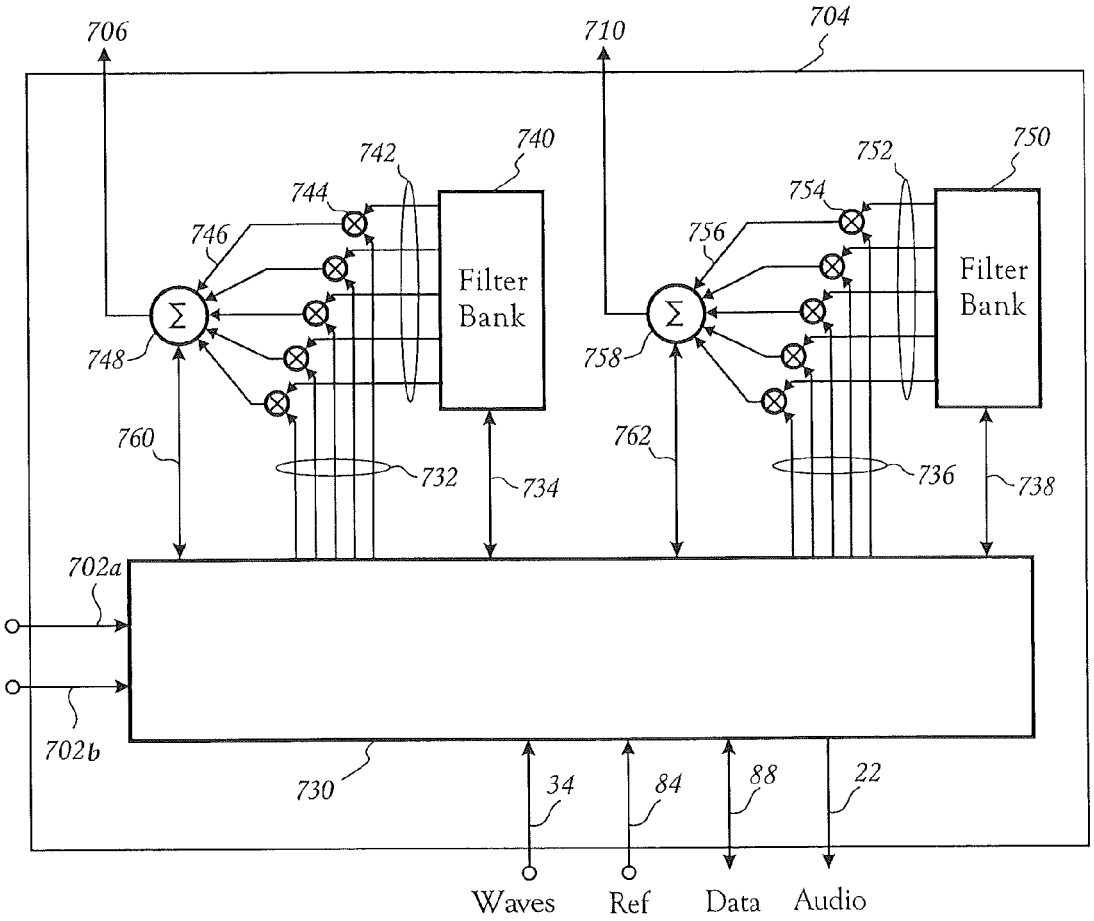
FIG. 7 is a schematic diagram of control law processing techniques according to some embodiments of the invention.
Figure 7:
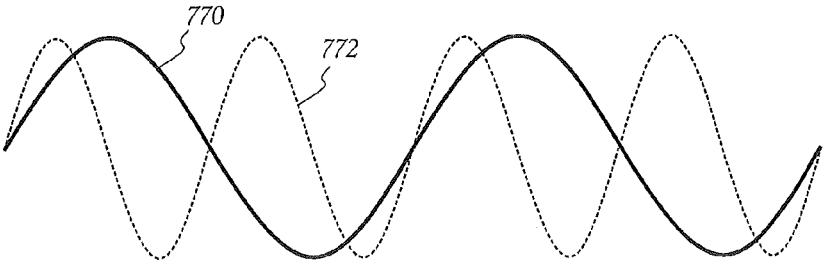

FIG. 7 illustrates the processing occurring within block 704 of FIG. 6 in some embodiments.

Velocity signals 702 enter block 730, where pitch estimation and spectral analysis is performed, as will be explained with reference to FIG. 8 herein. The resulting measured spectrum of the current string vibration is then compared to a reference spectrum supplied by a supervisor 30 on line 84 and a correction data set is generated.

To excite or damp selected harmonic components of string vibration the band pass filters, the filter banks 740 and 750 are each tuned to the frequency of a different harmonic of the string's vibration. The processor 730 routes velocity signal 702 to the filter banks 740 and 750 along data paths 734 and 738 where the individual harmonic components of the velocity signal are extracted as signal sets 742 and 752.

Following exemplary harmonic signal 742, the harmonic processor 744 scales signal 742 and sets its polarity, which determines if it has a constructive or destructive effect upon the corresponding harmonic motion of the string and the degree of that effect. If the harmonic signal 742 is routed to a transverse controller, then control law [1] is applied, and if the harmonic signal 742 is routed to a tension controller, then control law [2] is applied. Nonlinear control laws such as control law [2] may by applied here to the individual harmonic. The output of the processor 744 is a signal 746 which is now a correction component constructed to compel or constrain a single harmonic component of string motion. All such correction components are summed in summing block 748 as shown by the converging arrows, the sum forming the actuator signal 706. Summing block 748 also limits and compresses the overall amplitude of the actuator signal to fit within the available range of actuation, up to a limit of amplification gain consistent with control or stability. A similar series of operations is performed by filter bank 750, harmonic processor 754, etc., eventually forming the actuator signal 710. It is of note that processing each individual harmonic by control law [2] before summing the results produces an actuator signal 706 or 710 that is generally free of the spurious intermodulation products that would otherwise result.

At the bottom of FIG. 7 is an illustration of the relationship between lateral string displacement 770 and string tension 772 that is produced by the calculation of control law [2]. The relationship shown has a damping effect reducing displacement, and the opposite polarity of signals 772 would increase displacement 770.

The actuator signals 706 and 710 may be sent to separate actuators (not shown) and thus may be considered two different controllers with different control laws. These are made to work cooperatively by the action of block 730 under control of the supervisor 30 where it is determined that one or a subset of harmonics should be channeled through one actuator and the second subset channeled through another. These subsets may be chosen to overcome the difficulty of separating higher harmonics or to facilitate greater or more complete control of string motion than can be achieved with a single controller. Strategies for cooperative controller action include 1) sending odd harmonics to one controller and even harmonics to the other or vice versa, 2) sending all harmonic components being damped to one controller and all components being excited to the other, or vice versa, and/or 3) cycling through the set of harmonics sending just one harmonic at a time to either or both controllers for a time proportional to the period of the fundamental string vibration frequency or an integer multiple thereof. This latter strategy relies on the ability of the taut musical instrument string to persistently maintain a standing wave for some time after the generating stimulus has passed so that revisiting each harmonic individually in sequence over time gives rise to the desired harmonic spectrum on the string. Accordingly, only a single bandpass filter may be needed, thus entirely overcoming the difficulty of separating individual harmonic components using a bank of band pass filters.

As illustrated in FIG. 7, a certain time domain signal may be generated to drive a certain actuator of a control system. It is not generally necessary that the signal driving the actuator be a processed result of real-time string velocity. A synthetic signal derived from the waveform table or by any other computational synthesis may also be used, provided that the synthetic signal or other computational synthesis was synchronized in frequency and phase to the actual mechanical motion of the string as is the real-time string velocity signal. Having the facility of spectral analysis and having real-time information about the string in the velocity signal, it becomes possible to construct an actuation signal artificially and to synchronize that signal in frequency according to the pitch measurement available in the system and in phase by locking it to a time domain event in the velocity signal such as a zero crossing of that signal. Block 730 may substitute the synthetic actuation signal via lines 760 and 762.

The advantage of using such a synthetic actuation signal to drive the actuator is that instantaneous disturbances in the mechanical system of the string may not propagate through to the actuation signal. Using the synthetic method, it may be possible to effectively increase loop gain of the controller far beyond the point of stability and to maintain it there during the entire time that the controllers are being driven by a synchronized synthetic signal as against an actual real time velocity signal. From time to time, a real time closed loop control may be used, e.g., to refresh the frequency and phase parameters and rebuild a synthetic actuation signal. This method may overcome a number of practical difficulties attendant to commercial realization of controllers such as those presented herein.

Figure 8:
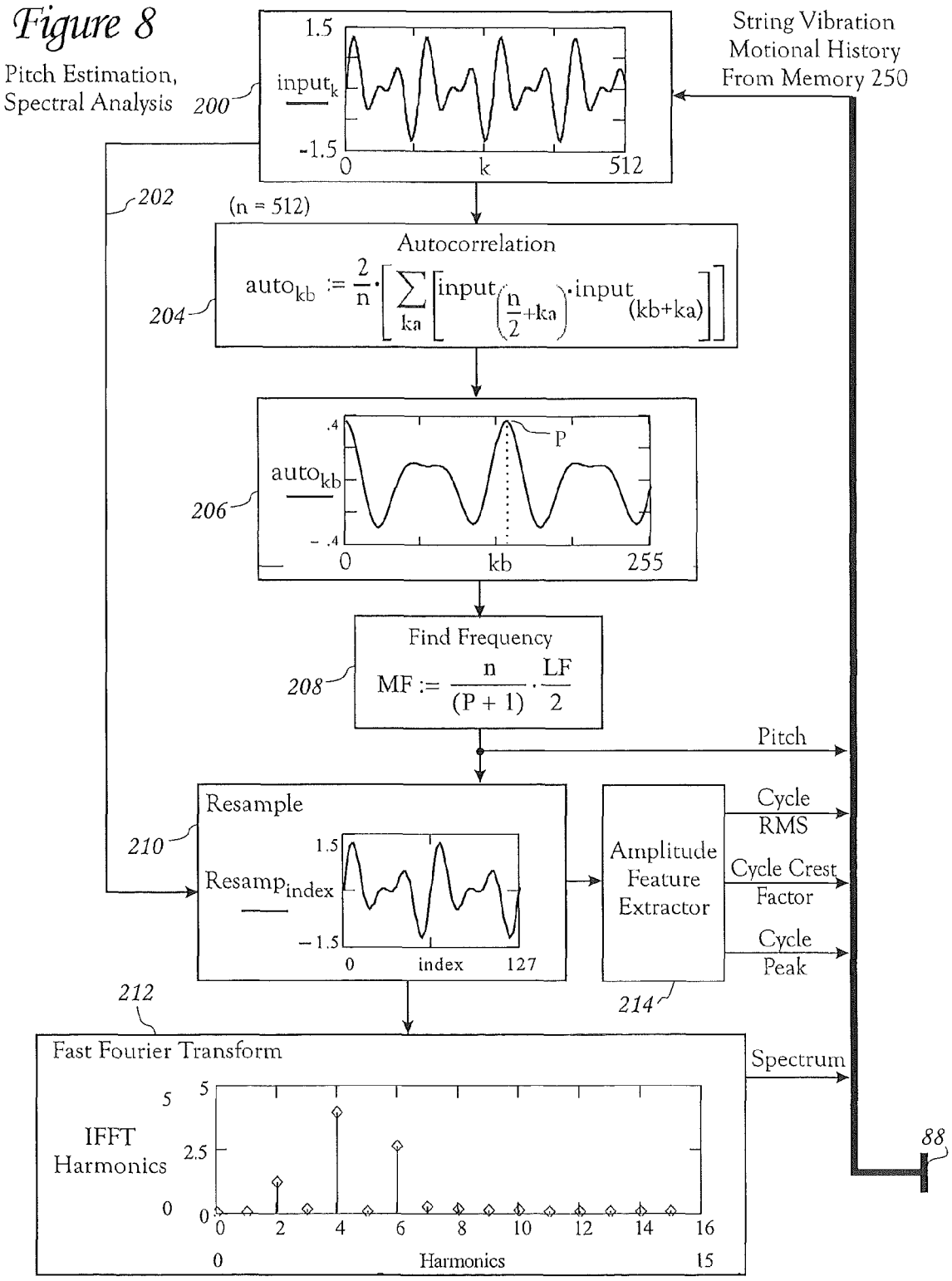
FIG. 8 is a schematic diagram of pitch estimation and spectral and amplitude feature extraction according to some embodiments of the invention.

FIG. 8 illustrates pitch estimation and spectral analysis according to some embodiments of the invention. Within the motion controllers 20 is a block labeled 730 that performs pitch estimation and spectral analysis, (PESA). The method to be described may be computationally intense but also very fast and suitably accurate.

With reference to FIG. 8, input to the PESA process is the most recent history of time-domain string motional data 200 continuously recorded within memory 250 (FIG. 9). The span of waveform history data 200 and FIG. 8 may contain at least two complete cycles of the expected lowest frequency fundamental of string vibration, and may be determined by the range of the stringed instrument. From the motional data 200, PESA extracts pitch and spectral feature signals and sends them to memory 250 over data path 88.

The waveform data 200 is representative of typical waveforms derived via pickups from string vibration. The software program "MathCad" was used to generate the graphs shown according to the calculations of the PESA process; however, any suitable software may be used. A process block 204 performs auto correlation of the first half of the data 200 against the last half of the data 200 and generates data 206. The variables ka and kb are index vectors with range=(0 . . . (n/2−1)), and n=512 in the example and may be dependent upon the sample rate in practice.

The process block 208 searches through data 206 for a point 'P' representing the index of location of the peak of correlation in the data 206. The fundamental frequency, (pitch), is given by the expression, where n=the number of points in the data set and LF=the frequency corresponding to the last point. The process block 210, having information relating to the fundamental, resamples the original data 200 to fit two cycles of the fundamental within a convenient radix-2 FFT input record. This may be done so there is no spectral "bleeding," so that a short FFT can be executed on the data.

The process block 212 executes a radix-2 FFT on the resampled data and produces a spectrum of harmonic magnitude versus frequency. The first datum is 0 Hz or DC and is not of interest except as an indication of possible error. Since two cycles of the first harmonic were fit to the FFT, only even numbered harmonics can be valid. If the value of odd-numbered harmonics exceeds a prescribed threshold, it may indicate an error in the pitch estimate, i.e., what was thought to be two cycles of the fundamental wasn't, and therefore there are unexpected harmonics in the FFT. In the instance of such an error, pitch and spectral output data may be ignored and the previous values may be substituted.

A spectrum feature data signal is assembled by taking the even-numbered points of FFT magnitude data. In some embodiments, the PESA process is redone for every new motional sample datum, i.e., once each time frame. This stream of pitch and spectral data is stored to memory 250 via data path 88 for use by other processes. One of ordinary skill in the art will recognize opportunities for improving the efficiency of the PESA techniques in this context with little impact on the quality of results.

A process block 214 performs amplitude feature extraction and provides the cycle RMS, the cycle crest factor, and the cycle peak of the associated string vibration as outputs to the path 88. The two exact cycles of data result of process 210 may be used. The averaging operation in the RMS calculation is performed across exactly N cycles of the waveform. An N of 2, for example, is appropriate. Similarly, the peak value of the waveform occurring over N cycles, and the crest factor, which is the cycle peak divided by the cycle RMS, are calculated for N cycles of fundamental.

A discussion of other suitable methods of pitch detection is found in an article entitled "High Accuracy and Octave Error Immune Pitch Detection Algorithms" by M. Dzuibi'Nski and B. Kostek, Multimedia Systems Department, Gda'nsk University of Technology, Narutowicza 11/12, 80-952 Gda'nsk, Poland. Background to the art of spectral analysis is found in Chapter 1 of DAFX and also pgs. 350-357 of DAFX. Almost any method of pitch estimation and spectral analysis will serve to put the fundamentals of the instant invention to practice, but embodiments will benefit from fast and accurate methods.

Non-Locality of Components

Some embodiments of the invention may include various combinations of subcomponents including, but not limited to, user interface components, transducer components, control components, supervisor components and guitar-like instrument components. For practical reasons some of these will be located in close proximity, i.e., will be a part of the instrument in the physical sense, while others may be more arbitrarily located but will still be a part of the instrument in the functional sense according to some embodiments. For example, using current communication technology it is obvious that the supervisor and/or the controller subcomponents or computational portions thereof could communicate with the physical instrument using, for example, a high speed long distance data communications medium and thus might be located anywhere from a few feet away to many miles away from the instrument itself. All such functional combinations, whether physically grouped at the instrument or not, are subsumed under the intent and scope of this invention.

FIG. 9 illustrates a supervisor system datagram according to some embodiments of the invention. Objects and processes that occur repeatedly according to the number of strings are shown in FIG. 9 as such through an artistic device 76. The structure presented in FIG. 9 is realized through software running on any suitable physical computing subsystem. FIG. 9 illustrates one possible such software. It is understood that the same functionality can be realized using different but functionally equivalent software structures and all such alternative structures are encompassed within the scope of the present invention.

The block 78 is understood to contain whichever portions of FIGS. 2, 3, 4, 5, 6, and 7 or combinations thereof that comports with the scope of the instant invention. Block 78 presents a consistent interface of motion controllers 20 to the rest of FIG. 9. Within each motion controller 20 there is a filter bank, a set of multipliers and a spectral magnitude subtractor, referenced in the original FIG. 10 of the U.S. Pat. No. 6,216,059 as 170, 172, and 162, respectively and herein incorporated in processing block 730, and in some embodiments modified to support dual control systems, (see FIG. 7). The mixer 26 and waveform server 36 are discussed previously with respect to FIG. 1.

The supervisor 30 controls all parameters of these processes including the selection of filter bank functions, i.e., band-pass, all-pass, simple gain or polarity inversions, etc., and can also read all register states including the results of spectral subtractions. Within the supervisor 30, FIG. 9 shows a number of process activities, each having a bi-directional interface to a memory system 250 that serves both as data storage and as an inter-process communications medium. The immediate and historical results of any process are available to all processes through a memory 250. This basic architecture is of a type known in the field of computer science to provide for efficient execution of several concurrent synchronous or asynchronous processes that must freely intercommunicate. Any other architecture known in computer science can be substituted as will be understood by one of skill in the art.

The memory system 250 may provide both private and public memory to each process and facilitates inter-process communications. The memory system 250 may provide at least enough space that is suitable to maintain circular memory buffers containing current history of all processor outputs. In some embodiments, the memory system 250 may be large enough to record all aspects of several entire musical performances; however, other sizes of memory may be used.

Processes

In the embodiment herein described, all processes receive input data by accessing it within memory 250 and all processes record their output data within memory 80. The inputs and outputs of processes as well as all control signal inputs shall all be normalized in range and expressed in common terms of magnitude so that any output data of any processor will be appropriately scaled to fit within the permitted input data range of any process or control signal input.

A software engineer experienced in writing digital signal processing software would commonly be aware of useful additions, alternatives and modifications to the techniques described herein. For example, it might improve accuracy to discard a pitch history datum if it diverges excessively in value from its adjacent data. Such well-understood details of digital signal processing are non-proprietary workshop matters of implementation that are not detailed herein for clarity and brevity.

Earlier processes extract primary features of vibration such as pitch and amplitude. Later processes recognize and measure technique commands, which are derived by reviewing the primary features using a variety of analytic and rule-based methods. Techniques subject to recognition are those that have been preselected during the manufacture of the system of via a set-up utility.

In DAFX, Section 9.4, and portions of Chapters 10 and 12 discuss relevant processing techniques and even provide specific programming examples.

Spectra Server

Spectra server 256 governs the spectral control loop of motion controllers 20 by providing and progressively updating reference spectra from memory 250 over data path 254 according to the command interpreter as will be described.

Spectral Balance Process

A spectral balance process 258 extracts a technique command from string vibration spectra as a spectral centroid datum indicative of the balance of energy between high and low harmonics of the spectra. Suitable formulae are presented at DAFX, pgs. 362-363.

Vibrato Technique Recognition Process

Figure 10:
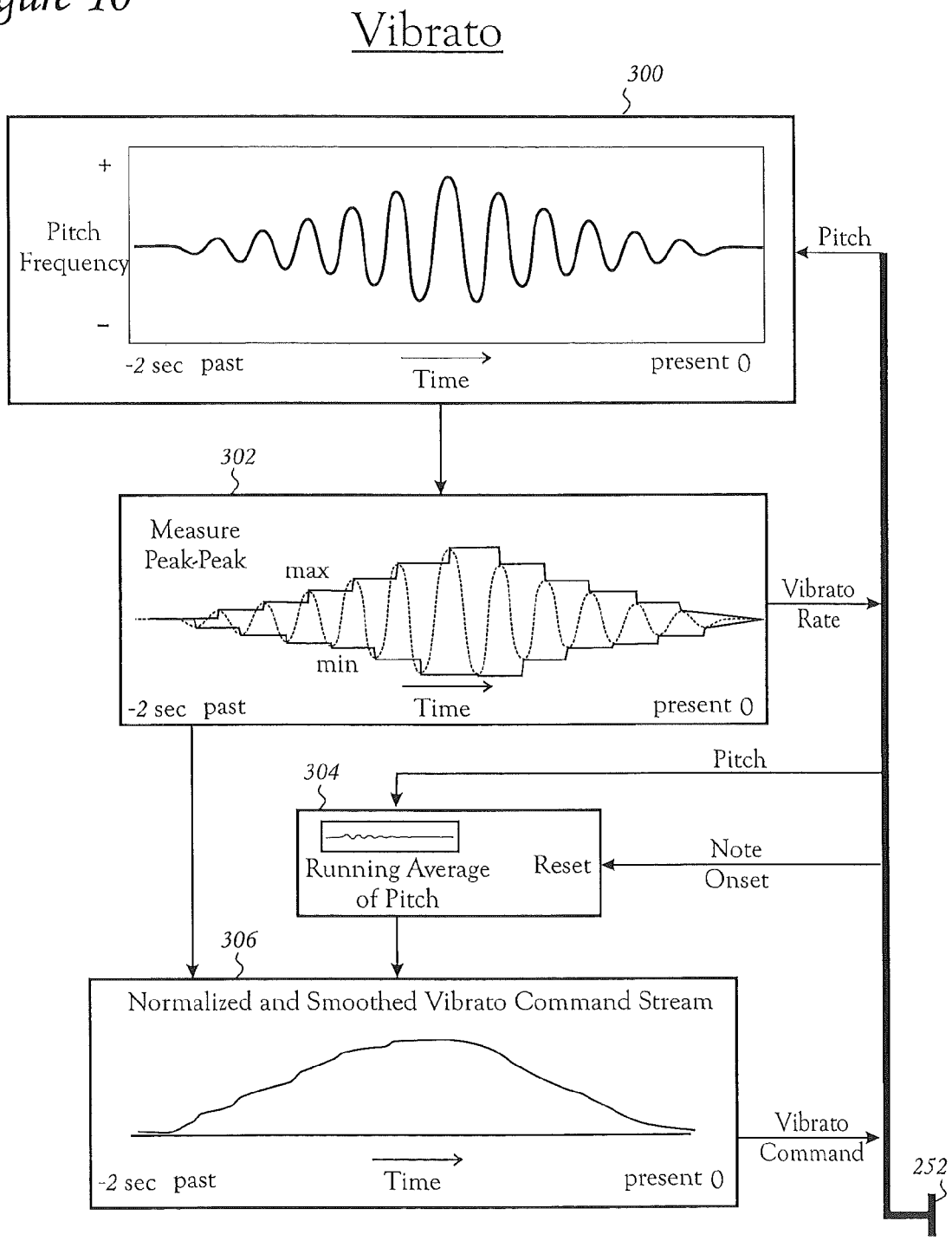
FIG. 10 is a schematic diagram illustrating a vibrato technique recognition process according to some embodiments of the invention.

A vibrato technique recognition process 260 is illustrated in FIG. 10.

Glissando Technique Recognition Process

Figure 11:
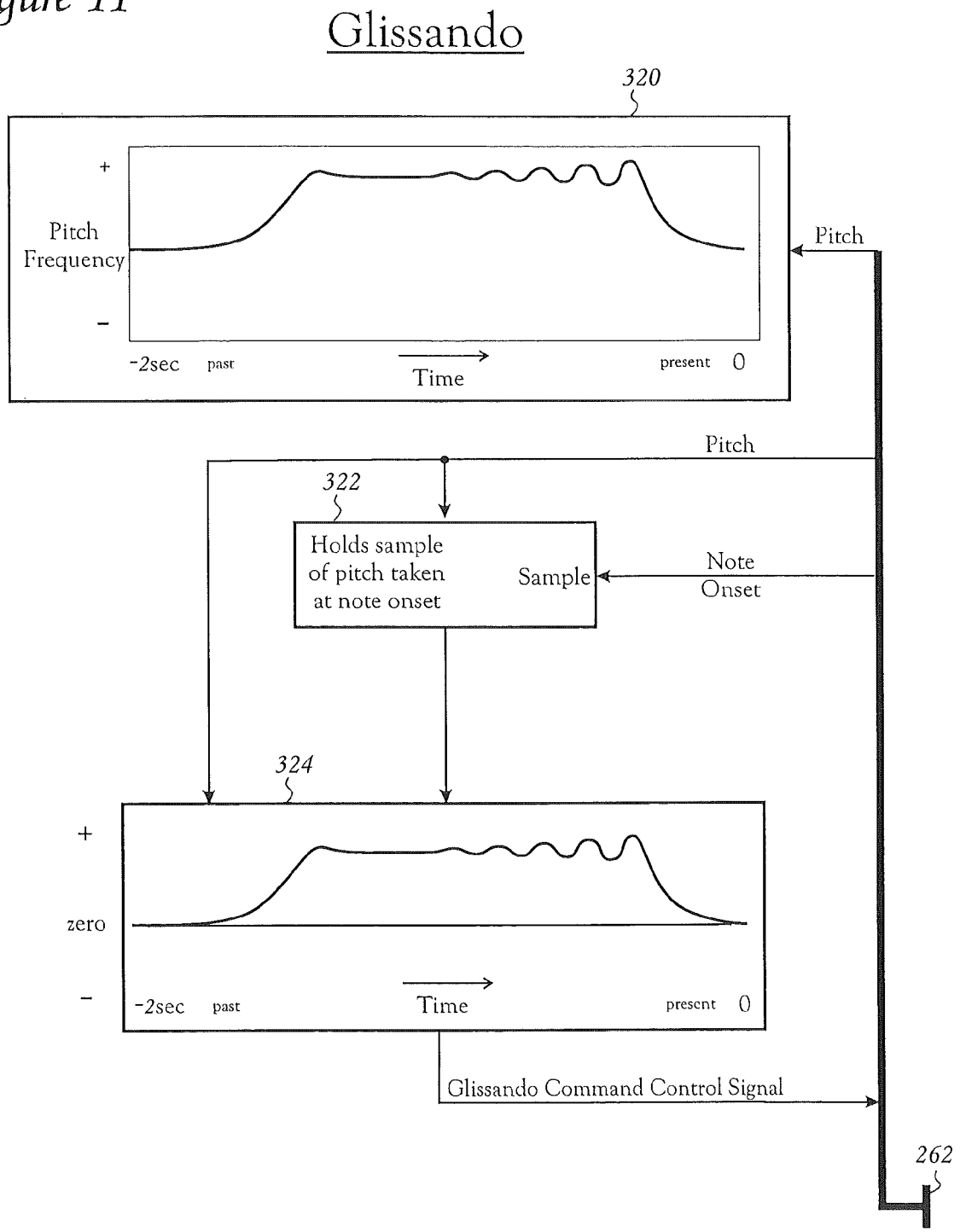
FIG. 11 is a schematic diagram illustrating a glissando technique recognition process according to some embodiments of the invention.

A glissando technique recognition process 264 is illustrated in FIG. 11.

Note Onset Command Detecting Process

Figure 12:
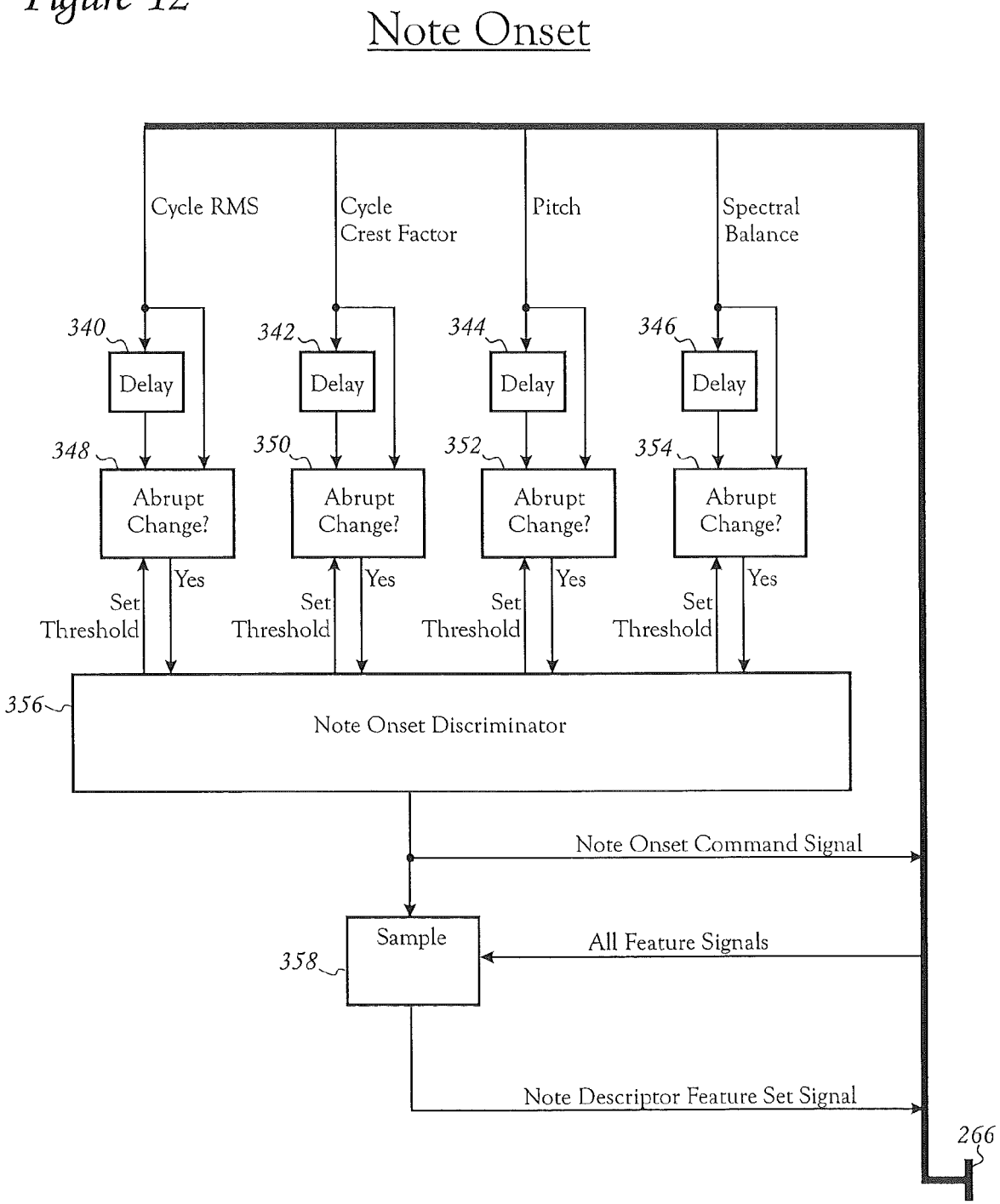
FIG. 12 is a schematic diagram illustrating a note onset technique recognition process according to some embodiments of the invention.

Process 268 for detecting new notes is detailed in FIG. 12.

Muting Recognition Processes

Figure 13:
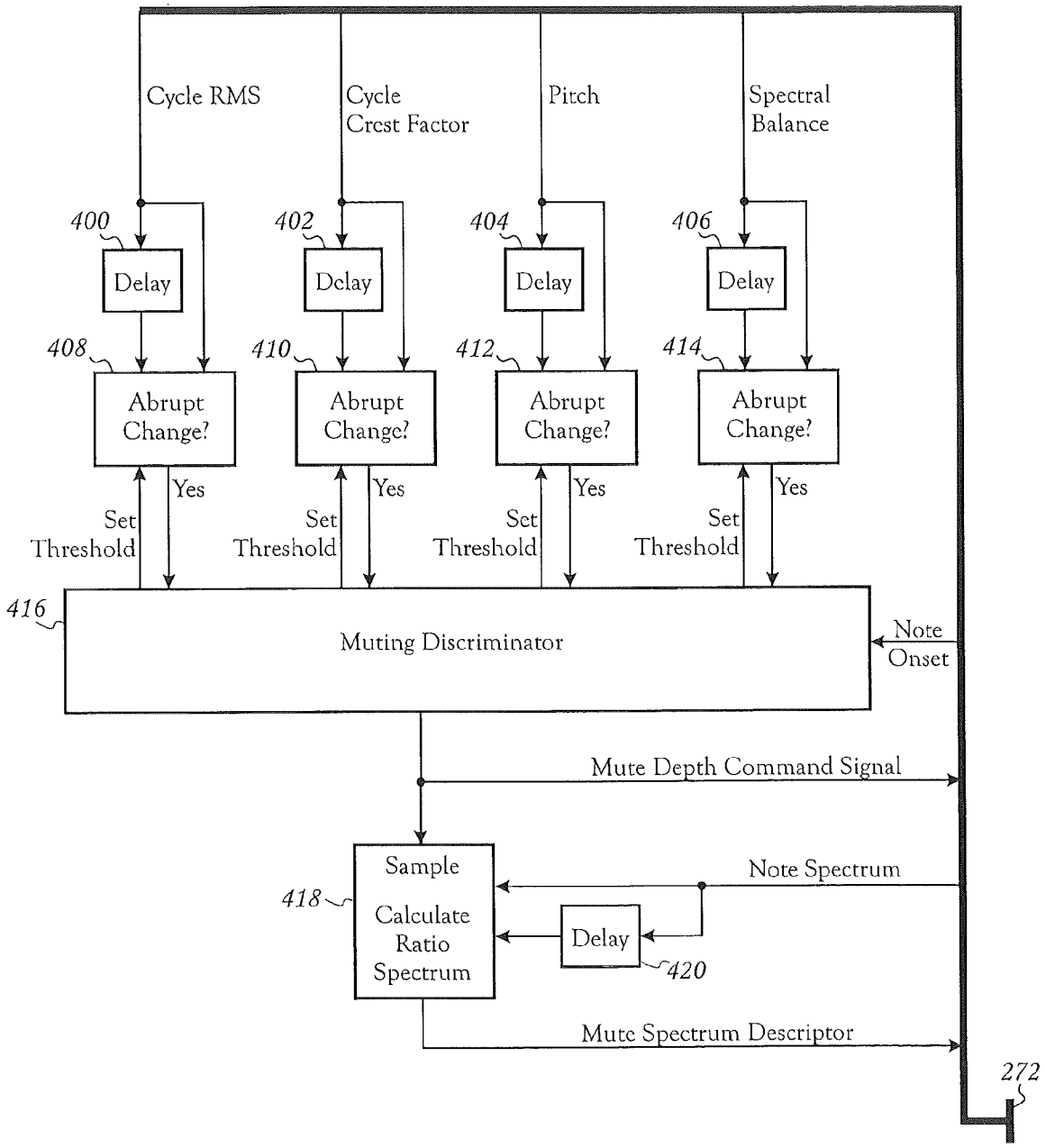
FIG. 13 is a schematic diagram illustrating a muting technique recognition process according to some embodiments of the invention.

When the guitarist purposefully causes notes to become quieter, he has given a mute command. A muting process 270 reviews various extracted features and recognizes such muting technique as an intentional command. FIG. 13 details a muting recognition process.

Last String Played Process

A last string process 274 considers the note onset signals from all strings and returns to memory as a datum the index of the string that was played last.

A last string played facility is described in U.S. Pat. No. 3,813,473. According to U.S. Pat. No. 3,813,473, a string signal is selected that is above a threshold and of attenuating all remaining string signals. However, in U.S. Pat. No. 3,813,473, attenuation is achieved electronically and the strings' vibrations are not actually damped.

In some embodiments, a mode is provided where only the last string played is permitted to vibrate while the rest of the strings are actively damped.

Phrase Recognition Process

The phrase recognition process 276 inputs the pitch signals for all strings and the note onset signals for all strings. It compares a stored database of musical phrases against phrases the musician is actually playing. When it finds a match, it issues a phrase index datum.

There is a single physical mode switch that permits this datum to be read and interpreted as a user mode command. In this way, a single physical switch, used in combination with note sequences of any length including 1, enables the instrumentalist to control an unlimited number of modal aspects of his instrument including replacing one instrument definition with another.

Processes 278, 280, 282 and 284 communicate with each other and memory 250 over path 286.

Command executive process 280 communicates over data path 286 and defines and operates the relationship between technique commands and motion control system inputs. The command executive interprets an instrument definition in terms of this relationship and is detailed in FIG. 14.

Instrument Definitions

A storage area 278 retains instrument definitions. Master program 282 selects which instrument definition is made active within command executive 280.

Master Program

A master program 282 is responsive to modal inputs such as mode selection signals from the phrase recognition process, from manual controls 14 over signal 38, and from the Aux UI 80 and digital interface 82 via communication interface 284.

The master program 282 may determine the mode by activating a selected instrument definition. The master program 282 may also manage software updates and have the capability to replace a portion or all portions of software with replacement software provided over digital interface 82.

A communication interface 284 may support the communication protocols utilized in embodiments of the invention such as 1394, TCP/IP, USB, etc. The addition of appropriate connectors and physical layer components needed to support the chosen protocols is understood.

FIG. 10 illustrates a vibrato process according to some embodiments of the invention. A data path 252 provides the current pitch and recent pitch history 300 to each vibrato process 260. The historical span may be long enough to contain at least one full cycle of undulation. Two seconds are shown in FIG. 10 to illustrate both increasing and decreasing vibrato.

A process block 302 tracks the peak-to-peak pitch change. The maximum pitch excursion per cycle of vibrato by sampling the pitch frequency on every negative zero crossing of the derivative of pitch (dp/dt). The corresponding minimum pitch is sampled at every positive zero crossing of dp/dt. By counting the number of times per second that the pitch signal crosses its own average, then dividing by two, the frequency of the modulation of the pitch signal is measured and provided to path 252 as a vibrato rate command.

A process block 304 maintains a running average or filtered pitch value. The average or filter state is reset by the note onset command and preloaded to the first measured pitch of the new note. The vibrato command magnitude is calculated by a process block 306 using (normalizer)*(max pitch−min pitch/average pitch) and is smoothed by a short-term running average. The "normalizer" is a scaling term to make the range comport with the ranges of other control signals.

FIG. 11 illustrates a glissando process according to some embodiments of the invention. A glissando process uses the most current pitch and the note onset command as inputs. A data path 262 provides this and other communication with the memory 250.

A waveform 320 is displayed in the figure to illustrate an example of how pitch changes in response to a player's glissando technique. Here, the guitarist "pulls" his string up a tone, adds vibrato to the pulled note, and then allows the note to fall back. A process block 324 calculates the running glissando magnitude by subtracting the most current pitch value from a note onset pitch value held by a sampler 322. The sampler 322 is gated by note onset commands. The resulting glissando command signal is normalized in scale to other control signals and sent to the memory 250 via path 262.

FIG. 12 illustrates a note onset detector process according to some embodiments of the invention. Inputs to each note onset process ma include the most recent pitch, spectral balance, cycle RMS and cycle crest factor feature signals. Delays 340, 342, 344 and 346 may delay each such input by an amount of time that yields meaningful comparisons. Delay values of a few milliseconds may be used. Threshold comparators 348, 350, 352 and 354 compare the ratiometric difference between current and delayed magnitudes of the feature signals against prescribed thresholds. If the resulting percentage increase or decrease of any feature signal exceeds its threshold, a datum representing the change percentage may be delivered to discriminator 356.

A note onset discriminator 356 is a process that uses rules to test weighted combinations of the change percentage data against prescribed thresholds to determine if the instrumentalist has deliberately started a new note. For each rule, the discriminator 356 sends a new set of thresholds to comparators 348, 350, 352 and 354. For example, one such rule would be, "If the pitch has changed by more than a semitone, issue a Note Onset command." Another such rule would be, "If the Spectral Balance and Cycle Crest Factors have shifted upwards but the Cycle RMS remains almost unchanged, issue a Note Onset command only if Pitch has been perturbed."

When a new note is recognized, the discriminator 356 sends or updates on the path 266, a note onset command signal that has the form of an up counter where 0 indicates the onset of a note and where the numeric progress of the counter indicates the time length of the note. A note onset command value of zero is used for synchronizing activities to notes by several other processes. At the instant of note onset, a feature sampler 360, connected to the memory 250 via the path 266, samples all features extracted from string vibration. This creates and stores to memory 250 a note descriptor signal that is the set of feature signals current at the time of note onset.

FIG. 13 illustrates a muting process according to some embodiments of the invention. The inputs and operations of the muting process may be almost identical to those of the note onset process. Delays are provided as 400, 402, 404 and 406. The threshold comparators are 408, 410, 412 and 414. The rules, thresholds, delays and outputs are different. For example, some exemplary rules of mute recognition are, "If the pitch has not changed and Cycle RMS is lower and the spectral balance has tilted down, issue a Mute Depth command," and "If the Cycle Crest Factor falls rapidly after a Note Onset and the Cycle RMS is declining, issue a Mute Depth command."

The output of muting discriminator 416 is a mute depth technique command signal representative of the amount or "urgency" of the muting extracted for the associated string, and a mute spectrum descriptor. A note onset command received on path 272 may clear all mute process output signals. A process block 418 makes ratiometric comparisons of a past note spectrum as provided by delay 420 and a present note spectrum, to create a mute spectrum descriptor. An updated mute spectrum descriptor may sent to memory 250 on path 272 whenever the mute depth signal causes the process block 418 to sample the descriptor. The mute spectrum descriptor indicates which harmonics were suppressed during the player's muting of the string and which were not. The significance of the mute spectrum descriptor is made greater by the other virtues of the invention. For example, by touching the string at nodes of selected harmonics, the player may mute other harmonics save the selected one. If he is also applying sustain-inducing vibrato, the selected harmonic will rise out of the note.

Figure 14:
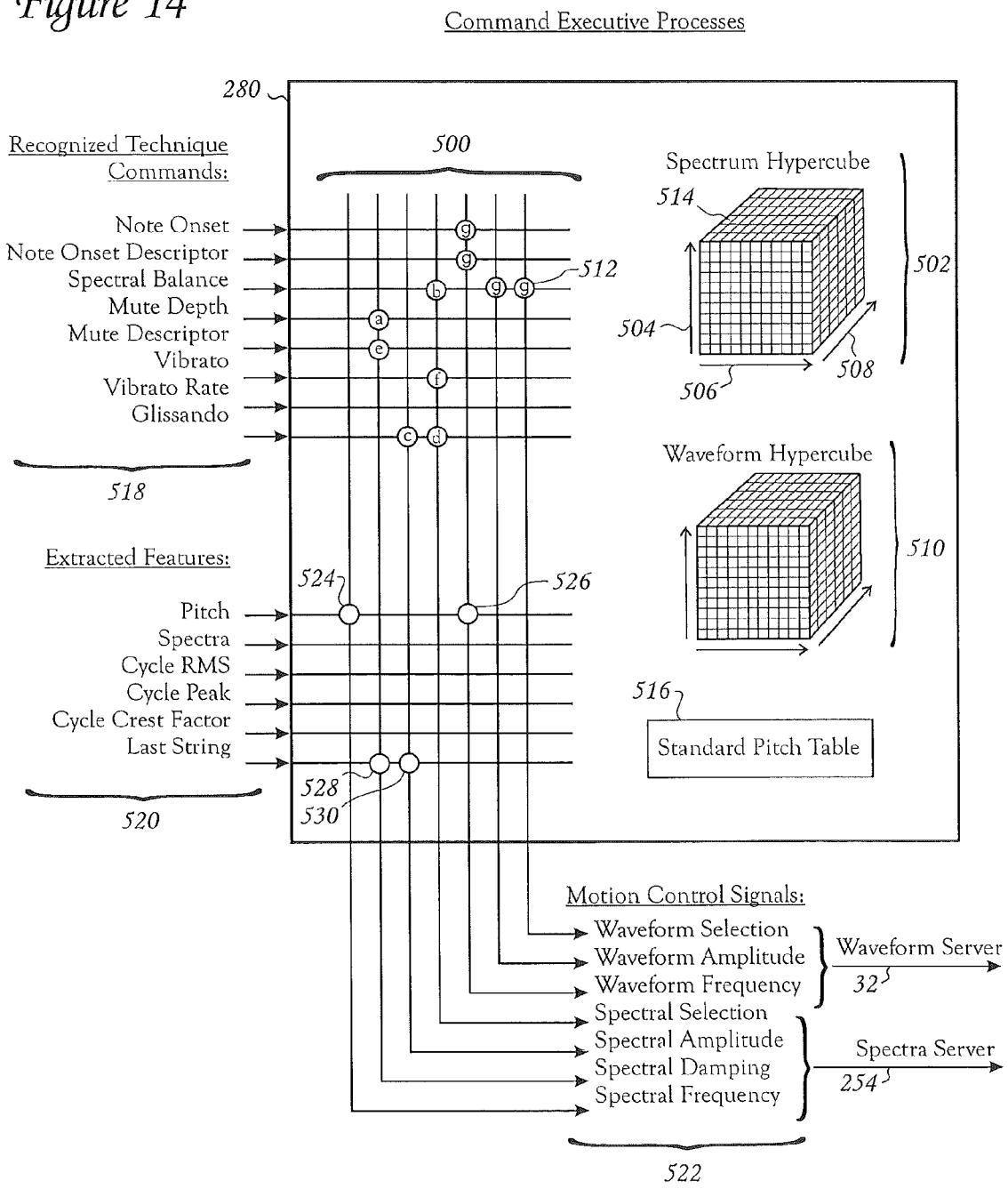
FIG. 14 is a schematic diagram illustrating a simplified matrix of the command executive process according to some embodiments of the invention.

FIG. 14 illustrates a command executive 280, which may bring together various playing technique commands and feature signals that have been described herein.

The Motion Control Signals output by Executive 280 are: Waveform server control signals for selecting and setting attributes of waveform reference signals output by waveform server 36 as signal 34, (see FIG. 9), Spectra server control signals 254 for selecting and setting attributes of spectral reference signals output as signal 84 by the spectral server, (see FIG. 9).

Mapping matrix 500 presents cross points between input commands and features 518 and 520, and output motion control signals 522. Horizontal signal lines are inputs while vertical signal lines are outputs. Motion control signals 522 pass on path 286 to memory 250 and then to paths 32 and 254.

At selected cross points, a script such as script 512 is installed to execute as a continuous sub-process and several scripts can execute concurrently. The active instrument definition determines what scripts are installed and where. The script is a software code that defines the relationship between the input control signal and the output control signal of the matrix. Any imaginable relationship can be defined, and the script can access other signals to create composite responses.

Alternative techniques for achieving substantially the same functionality include, but are not limited to, evolutionary computational techniques, neural networks and other such architectures and method that are trainable and/or self-organizing. Such a system would connect to all inputs and outputs shown on FIG. 14, and may use an additional training input to be accessed by a manufacturer during a training process. For example, to train such a system to respond to vibrato by increasing sustain, one would expose the learning network's inputs as shown in FIG. 14 to feature signals and technique commands characteristic of vibrato, and one would provide the training input with feature signals characteristic of sustained string motion as the desired result. Once trained, the supervisory system may respond to vibrato with sustain. The result of such an approach will still be, in essence, a rule-based system, but the rules will have been generated and recorded within the supervisor by the software itself, not supplied by a human designer.

These any other suitable techniques for establishing a complex relationship between one or more input signals and one or more output signals such that provides the functions of FIG. 14 falls within the scope of the instant invention.

A spectrum hypercube 502 is shown having three dimensions 504, 506 and 508; however, the hypercube 502 could have additional dimensions. The spectrum hypercube 502 illustrates how several control signals can act together to select a unique spectral reference signal from stored spectra. Note that in the example matrix 500, three scripts b, f and d are all governing the spectral selection control signal. If spectral balance controlled the 504 axis, vibrato controlled the 506 axis and glissando controlled the 508 axis of spectrum hypercube 502, a unique spectrum would be selected for every quantized step of each control signal.

Another waveform hypercube 510 may operate as the spectrum hypercube 502 in selecting waveforms according to several control signal inputs. A standard pitch table 516 is present to enable the tuning of the instrument to be pulled towards a standard tempered scale by the action of motional feedback. This would be done if scripts 524 or 526 called for tuning. The scripts 528 and 530 would mute all but the last string played if in arpeggio mode. Some matrix scripts such as 512 are shown with a letter enclosed in a circle. The letter corresponds to the instrument definition example given below and shows how the matrix can be used to interpret an instrument definition:

The following is a non-limiting example of an instrument definition according to some embodiments of the present invention:

(a) Open strings sounding below 20% of the average string amplitudes shall be held mute by electronic damping.
(b) The spectral balance of a string's vibration shall select spectral references from a set of spectral references indexed by the control signal.
(c) Pulling a string so that the note rises in pitch shall increase sustain amplitude.
(d) Pulling a string, plucking it, and then slowly reducing the tension to lower the pitch of the note shall cause the note's second harmonic to increase in amplitude and the first harmonic to decrease in amplitude.
(e) A sudden decrease in string amplitude, (as by hand muting), shall enable electronic damping of that string.
(f) If the player applies vibrato to one or more notes in a chord, the chord shall be sustained and a predetermined series of harmonics shall be evoked within the vibrations of the strings making up the chord.
(g) If the player plays very close to the bridge of his instrument, each manual plucking of a string shall elicit a series of rapid electromagnetic "plucking" actuating events upon that string.

Although embodiments according to the invention are described herein with respect to a guitar, it should be understood that any suitable stringed instrument may be used. The guitar is often cited herein by way of example, but all aspects of the invention are intended to apply to all fundamentally similar stringed instruments, fretted and unfretted, acoustic and electrified.

The preceding example is but one of an endless series of instrument definitions made possible by the invention. Some definitions will find more favor with musicians than others, but all such definitions fall under the scope and intent of the invention. The invention does not have one fixed behavior, instead, much as a computer is an invention that allows many different programs to be written by programmers and executed on the same computer hardware, the invention allows for many variations of instrument to be defined by instrument designers. Thus various different manufactures of instruments employing the instant invention can differentiate their offerings according to their design choices, while using a standardized hardware embodiment of the invention produced inexpensively in high volume.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the instant invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A circuit for sensing motion of a musical instrument string, the circuit comprising:

an ultrasonic emitter configured to emit ultrasonic vibrations of a wavelength smaller than a diameter of the string so that ultrasonic vibrations from the ultrasonic emitter impinge upon and are reflected by the string; and at least one ultrasonic sensor configured to receive the ultrasonic vibrations reflected by the string, wherein the ultrasonic emitter and the ultrasonic sensor comprise resonant cylindrical chambers in a substrate material, one face of each chamber comprising an electrically conductive elastic membrane electrode, the membrane electrode of the ultrasonic emitter chamber being driven by an excitation voltage pulsing at the resonant frequency of the chamber or integer multiple thereof, and the ultrasonic sensor chamber produces a voltage signal by the modulation of a charged capacitance according to the deformations of the membrane electrode impinged by ultrasonic pressure variations.

2. The circuit of claim 1, wherein the at least one ultrasonic sensor comprises at least a first ultrasonic sensor configured to receive the ultrasonic vibrations reflected by the string vibrating in a first plane normal to the first ultrasonic sensor and at least a second ultrasonic sensor configured to receive the ultrasonic vibrations reflected by the string vibrating in a second plane normal to the second ultrasonic sensor, the first plane being rotated about the axis of the string by approximately 90° with respect to the second plane.

3. The circuit of claim 1 wherein the circuit is configured to receive the reflected ultrasonic vibrations, to measure a Doppler shift in the reflected ultrasonic vibrations, and to form a signal representing the velocity of string motion responsive to the Doppler shift.

4. The circuit of claim 3 wherein the velocity of string motion is represented by pair of signals describing string motion on orthogonal planes.

5. The circuit of claim 1, wherein the at least one ultrasonic sensor comprises at least a first ultrasonic sensor configured to receive the ultrasonic vibrations reflected by the string vibrating in a first plane normal to the first ultrasonic sensor and at least a second ultrasonic sensor configured to receive the ultrasonic vibrations reflected by the string vibrating in a second plane normal to the second ultrasonic sensor, the first plane being rotated about an axis of the string by approximately 90° with respect to the second plane.

6. A system for controlling a vibration of a musical instrument string, the system comprising:

a circuit for sensing motion of a musical instrument string, the circuit comprising:

an ultrasonic emitter configured to emit ultrasonic vibrations of a wavelength smaller than a diameter of the string so that ultrasonic vibrations from the ultrasonic emitter impinge upon and are reflected by the string; and at least one ultrasonic sensor configured to receive the ultrasonic vibrations reflected by the string, wherein the ultrasonic emitter and the ultrasonic sensor comprise resonant cylindrical chambers in a substrate material, one face of each chamber comprising an electrically conductive elastic membrane electrode, the membrane electrode of the ultrasonic emitter chamber being driven by an excitation voltage pulsing at the resonant frequency of the chamber or integer multiple thereof, and the ultrasonic sensor chamber produces a voltage signal by the modulation of a charged capacitance according to the deformations of the membrane electrode impinged by ultrasonic pressure variations, wherein the circuit outputs a signal representing a lateral vibration of the musical instrument;

a controller configured to receive the signal representing a lateral vibration of the musical instrument and to determine an actuating signal for driving at least one transducer to apply a longitudinal actuating force to the string at a termination point of the string, the longitudinal actuating force being operable to modulate a tension of the string that increases and/or damps the lateral vibration and/or selected harmonics thereof.

7. The system of claim 6, further comprising a supervisor configured to cause the controller to provide an actuating signal that modifies a vibratory motion of the string in accordance with a measurement of vibrato occurring on the string.

8. The system of claim 7, wherein the measurement of vibrato occurring on the string comprises a measurement of a magnitude of a pitch change due to vibrato, and the actuating signal that modifies the vibratory motion of the string comprises an actuating signal that excites and sustains string vibration according to the magnitude of the pitch change due to vibrato.

9. The system of claim 6, wherein the controller is configured to analyze a vibration history and to provide an automatic transcription or musical score based on the vibration history.

10. The system of claim 6, wherein the musical instrument string comprises nylon.

11. The system of claim 6, wherein the at least one ultrasonic sensor comprises at least a first ultrasonic sensor configured to receive the ultrasonic vibrations reflected by the string vibrating in a first plane normal to the first ultrasonic sensor and at least a second ultrasonic sensor configured to receive the ultrasonic vibrations reflected by the string vibrating in a second plane normal to the second ultrasonic sensor, the first plane being rotate about the axis of the string by approximately 90° with respect to the second plane.

* * * * *